US009786451B2

(12) United States Patent
Morioka et al.

(10) Patent No.: US 9,786,451 B2
(45) Date of Patent: Oct. 10, 2017

(54) REMOTE CONTROL DEVICE FOR TOILET DEVICE

(71) Applicant: TOTO Ltd., Kitakyushu-shi, Fukuoka (JP)

(72) Inventors: Satoko Morioka, Kitakyushu (JP); Masami Yamanaka, Kitakyushu (JP)

(73) Assignee: TOTO, Ltd., Kitakyushu-shi, Fukuoka (JP)

( * ) Notice: Subject to any disclaimer, the term of this patent is extended or adjusted under 35 U.S.C. 154(b) by 340 days.

(21) Appl. No.: 14/733,504

(22) Filed: Jun. 8, 2015

(65) Prior Publication Data

US 2015/0364278 A1 Dec. 17, 2015

(30) Foreign Application Priority Data

Jun. 17, 2014 (JP) ..... 2014-124565

(51) Int. Cl.

| | |
|---|---|
| ***H01H 3/00*** | (2006.01) |
| ***H01H 9/54*** | (2006.01) |
| ***H01H 33/59*** | (2006.01) |
| ***H01H 47/00*** | (2006.01) |
| ***H01H 85/46*** | (2006.01) |
| ***H01H 13/70*** | (2006.01) |
| ***G08C 17/00*** | (2006.01) |
| *E03D 5/10* | (2006.01) |
| *E03D 9/08* | (2006.01) |

(52) U.S. Cl.

CPC ..... *H01H 13/7006* (2013.01); *G08C 17/00* (2013.01); *E03D 5/10* (2013.01); *E03D 9/08* (2013.01); *G08C 2201/112* (2013.01); *H01H 2231/032* (2013.01)

(58) Field of Classification Search

USPC ..... 307/139; 315/55

See application file for complete search history.

(56) References Cited

U.S. PATENT DOCUMENTS

2005/0280334 A1* 12/2005 Ott ..... H01L 41/1136 310/339
2010/0097192 A1* 4/2010 Weston ..... B60C 23/0408 340/10.3
2010/0231407 A1* 9/2010 Carr ..... G06K 19/0723 340/691.1
2010/0244629 A1* 9/2010 Nagashima ..... H01L 41/053 310/339
2011/0012479 A1* 1/2011 Nakamura ..... B60C 23/0411 310/339
2011/0018397 A1* 1/2011 Fujimoto ..... H01L 41/113 310/339
2011/0304240 A1* 12/2011 Meitav ..... A61N 1/3785 310/319
2012/0007470 A1* 1/2012 Kurihara ..... H01L 41/1136 310/329

(Continued)

*Primary Examiner* — Adam Houston

(74) *Attorney, Agent, or Firm* — Banner & Witcoff, Ltd.

(57) ABSTRACT

According to one embodiment, a remote control device for a toilet device includes an operation button and a power generator. The operation button is capable of a push operation and is configured to operate an equipment in response to the push operation. The power generator is configured to generate a power by being pressed in response to the push operation. A direction of the pressing is parallel to a wall surface on which the remote control device is placed.

5 Claims, 18 Drawing Sheets

(56) References Cited

U.S. PATENT DOCUMENTS

| | | | | |
|---|---|---|---|---|
| 2013/0046463 | A1* | 2/2013 | Bengtson | G01C 21/165 701/500 |
| 2013/0181578 | A1* | 7/2013 | Kameda | B60C 23/0411 310/339 |
| 2013/0293069 | A1* | 11/2013 | Sakaguchi | H02N 2/186 310/348 |
| 2014/0265733 | A1* | 9/2014 | Balasingam | H02N 2/185 310/339 |
| 2015/0145375 | A1* | 5/2015 | Sakaguchi | H01L 41/1136 310/321 |
| 2015/0256107 | A1* | 9/2015 | Bae | H01L 41/113 310/330 |
| 2015/0303835 | A1* | 10/2015 | Katsumura | H01L 41/1136 310/329 |
| 2015/0364278 | A1* | 12/2015 | Morioka | H01H 13/7006 200/341 |
| 2016/0072411 | A1* | 3/2016 | Mihara | H02N 2/18 318/116 |
| 2016/0126865 | A1* | 5/2016 | Kim | H02N 2/185 310/339 |
| 2016/0226403 | A1* | 8/2016 | Kajino | B25J 9/12 |
| 2016/0308469 | A1* | 10/2016 | Horiguchi | G08C 17/02 |
| 2016/0315563 | A1* | 10/2016 | Horiguchi | H01L 41/083 |
| 2017/0141702 | A1* | 5/2017 | Tsuyuki | H02N 2/001 |
| 2017/0162780 | A1* | 6/2017 | Takahashi | B25J 9/12 |

* cited by examiner

REMOTE CONTROL DEVICE FOR TOILET DEVICE

CROSS-REFERENCE TO RELATED APPLICATIONS

This application is based upon and claims the benefit of priority from Japanese Patent Application No. 2014-124565, filed on Jun. 17, 2014; the entire contents of which are incorporated herein by reference.

FIELD

Embodiments described herein relate generally to a remote control device for toilet device.

BACKGROUND

Remote control devices for remotely controlling electronic equipment are provided in water-related facilities such as toilet room, bathroom, kitchen, and shower booth. Such remote control devices include a remote controller for a sanitary washing device. The remote controller is operated without power supply, thereby dispensing with a power cord or battery (Japanese Unexamined Patent Publication 2006-9280).

In the remote controller for a sanitary washing device disclosed in Japanese Unexamined Patent Publication 2006-9280, when a user pushes down a switch, a piezoelectric power generation device generates electric power. The controller of the remote controller uses this power to wirelessly transmit a prescribed signal to the controller provided in the main section of the sanitary washing device. The remote controller for a sanitary washing device disclosed in Japanese Unexamined Patent Publication 2006-9280 secures power for communication by the push operation. Thus, there is no need of a battery and commercial power source. This can realize a device being maintenance-free (dispensing with battery exchange) and wire-free (dispensing with wiring work).

However, a remote controller using a push operation for self-power generation may produce a relatively large sound when the power generation device is pushed. In general, a remote controller for a sanitary washing device is placed on the wall surface of a toilet booth so that the user seated on the toilet seat can easily push the operation button. In this case, when the user pushes the operation button, the sound produced by the power generation device being pushed may propagate to e.g. the adjacent toilet booth. Then, the user of the adjacent toilet booth may erroneously think that the remote controller is automatically operated without his/her operation. Alternatively, the user of the adjacent toilet booth may be annoyed with the sound of the power generation device propagated through the wall of the toilet booth. Alternatively, the user of the adjacent toilet booth may erroneously think that the remote controller is faulty.

SUMMARY

According to one embodiment, a remote control device for a toilet device includes an operation button and a power generator. The operation button is capable of a push operation and is configured to operate an equipment in response to the push operation. The power generator is configured to generate a power by being pressed in response to the push operation. A direction of the pressing is parallel to a wall surface on which the remote control device is placed.

DETAILED DESCRIPTION

Figure 1:
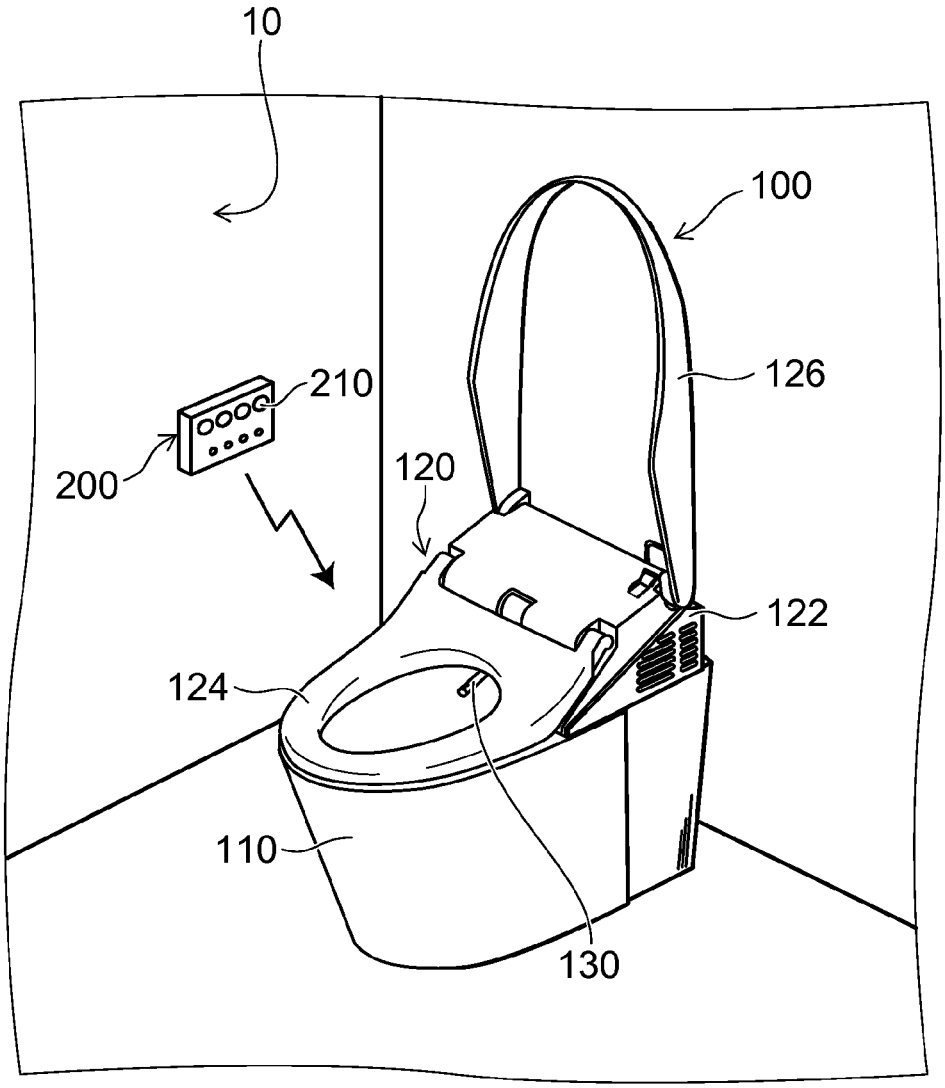
FIG. 1 is a schematic perspective view showing a remote control device for a toilet device according to an embodiment of the invention.

A first aspect of the invention is a remote control device for a toilet device, comprising an operation button being capable of a push operation and being configured to operate an equipment in response to the push operation, and a power generator configured to generate a power by being pressed in response to the push operation. A direction of the pressing is parallel to a wall surface on which the remote control device is placed.

In this remote control device for a toilet device, the power generator is pressed in the direction parallel to the wall surface on which the remote control device is placed. Thus, the sound produced by the power generator being pressed is likely to propagate generally in parallel to the wall surface. Thus, the energy of pressing the power generator is less likely to propagate to the wall surface. This can suppress vibration propagated from the remote control device for a toilet device to the wall surface. Furthermore, this can suppress the sound propagated from the remote control device for a toilet device to the wall surface.

A second aspect of the invention is a remote control device for a toilet device according to the first aspect of the invention, further comprising a remote control body including a member attached to the wall surface, and a base provided inside the remote control body. The power generator is held on the base.

In this remote control device for a toilet device, the power generator is held not on the remote control body, but on the base provided inside the remote control body. Thus, the power generator is provided at a position spaced from the wall surface. This can further suppress the vibration and sound propagated from the remote control device for a toilet device to the wall surface.

A third aspect of the invention is a remote control device for a toilet device according to the first or second aspect of the invention, further comprising a transfer mechanism including a member performing the pressing by moving in the direction parallel to the wall surface in response to the push operation.

In this remote control device for a toilet device, the power generator can be pressed in a relatively simple configuration.

A fourth aspect of the invention is a remote control device for a toilet device according to the third aspect of the invention, wherein the operation button includes a pushing part. The transfer mechanism includes a receiving part configured to receive a force from the pushing part in response to the push operation and to move the member performing the pressing.

In this remote control device for a toilet device, the receiving part receives a force from the pushing part of the operation button. This can smoothly move the member pressing the power generator.

A fifth aspect of the invention is a remote control device for a toilet device according to one of the first to fourth aspects of the invention, wherein the direction of the push operation has a component perpendicular to the wall surface.

In this remote control device for a toilet device, the power generator can be pressed by the same method as the method for operating a conventional remote control device.

Various embodiments will be described hereinafter with reference to the accompanying drawings. In the drawings, similar components are labeled with like reference numerals, and the detailed description thereof is omitted appropriately.

The remote control device according to the embodiments of the invention is used in water-related facilities (equipment) such as toilet room, bathroom, kitchen, and shower booth. In the following description, a remote control device for a toilet device is taken as an example. That is, in the following description, the case where the equipment operated by the remote control device is a toilet device is taken as an example. However, the remote control device according to the embodiments of the invention is not limited to the remote control device for a toilet device.

FIG. 1 is a schematic perspective view showing a remote control device for a toilet device according to an embodiment of the invention.

As shown in FIG. 1, the remote control device 200 for a toilet device according to this embodiment (hereinafter simply referred to as "remote control device") is placed on e.g. the wall surface 10 of a toilet room, and used with a toilet device 100. The remote control device 200 includes an operation button 210. The operation button 210 is e.g. what is called a push button capable of push operation (press operation). The operation button 210 is movable to an ordinary position and a lowermost position. The operation button 210 moves from the ordinary position to the lowermost position in response to the push operation. The operation button 210 is held at the ordinary position by e.g. a spring 336 (see, e.g., FIGS. 9 and 11) when not operated. The operation button 210 returns to the ordinary position by deactivation of the push operation after being moved to the lowermost position by the push operation.

The remote control device 200 detects the operation of the operation button 210. The remote control device 200 transmits a wireless signal depending on the operated operation button 210 to the toilet device 100. The toilet device 100 receives the wireless signal transmitted from the remote control device 200. The toilet device 100 performs an action depending on the wireless signal. Thus, the remote control device 200 instructs the toilet device 100 to perform a prescribed action depending on the user's operation. Accordingly, the remote control device 200 remotely controls the toilet device 100.

The toilet device 100 includes a sit-down toilet stool (hereinafter simply referred to as "toilet stool") 110 and a toilet seat unit 120 provided on the toilet stool 110.

The toilet seat unit 120 includes a main section 122, a toilet seat 124, and a toilet lid 126. The toilet seat 124 and the toilet lid 126 are each pivotally supported on the main section 122 in an openable/closeable manner. FIG. 1 shows the state of the toilet lid 126 being opened. FIG. 1 shows the state of the toilet seat 124 being closed. The toilet lid 126 in the closed state covers the upside of the toilet seat 124. The toilet lid 126 does not necessarily need to be provided.

The toilet seat unit 120 has e.g. a sanitary washing function, a private part drying function, and a toilet seat warming function. The sanitary washing function is the function of performing a washing action for washing the "bottom" and the like of the user seated on the toilet seat 124 by a nozzle 130. The private part drying function is the function of performing a drying action for drying the "bottom" and the like wetted by sanitary washing by blowing warm air to the "bottom" and the like of the user seated on the toilet seat 124. The toilet seat warming function is the function of performing a toilet seat heating action for warming the seating surface of the toilet seat 124 to a suitable temperature.

The toilet seat unit 120 performs the action of e.g. the sanitary washing function based on the wireless signal transmitted from the remote control device 200. Alternatively, the toilet seat unit 120 performs the action of e.g. the private part drying function based on the wireless signal transmitted from the remote control device 200. Alternatively, the toilet seat unit 120 performs the action of e.g. the toilet seat warming function based on the wireless signal transmitted from the remote control device 200.

Figure 2:
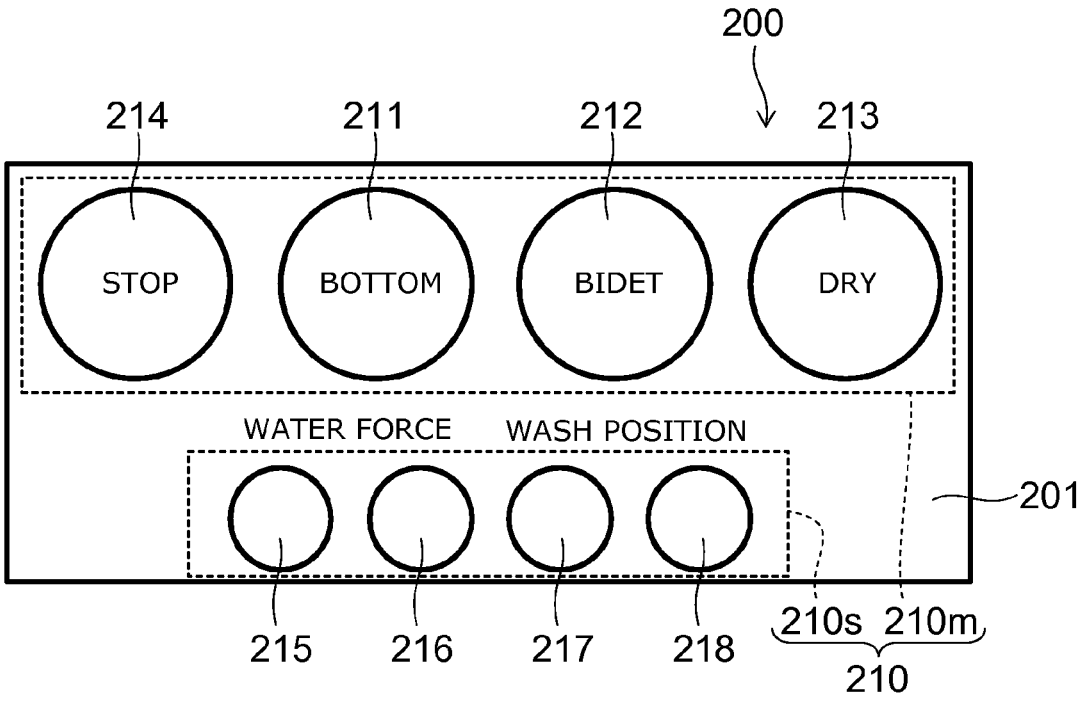
FIG. 2 is a schematic plan view showing the remote control device according to this embodiment.

FIG. 2 is a schematic plan view showing the remote control device according to this embodiment.

Figure 3A:
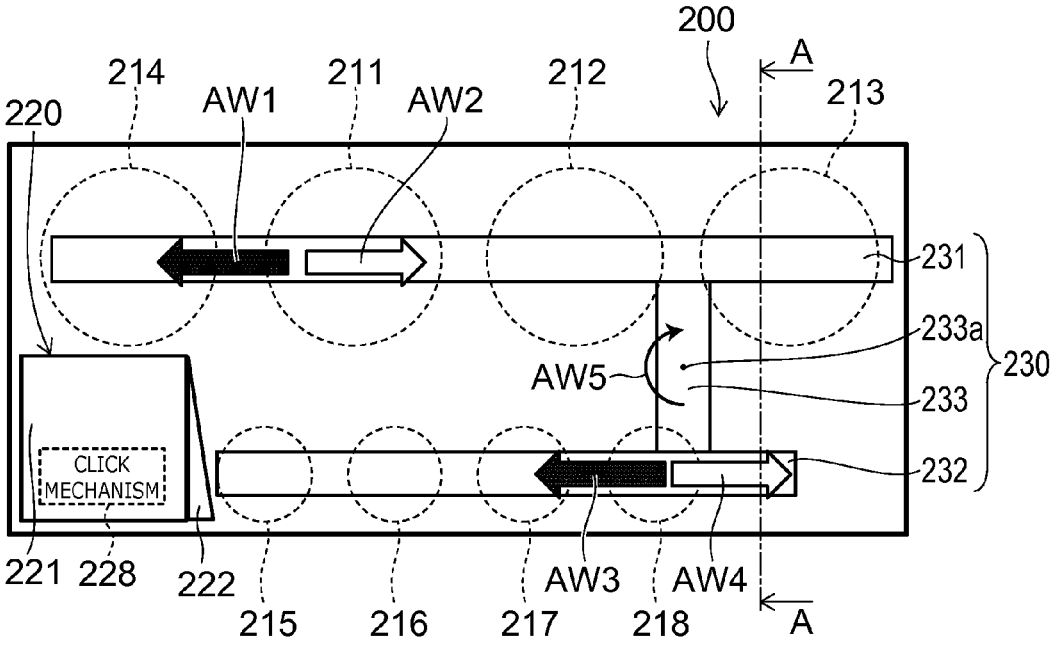
FIGS. 3A to 3C are schematic views showing the remote control device according to this embodiment.
Figure 3B:
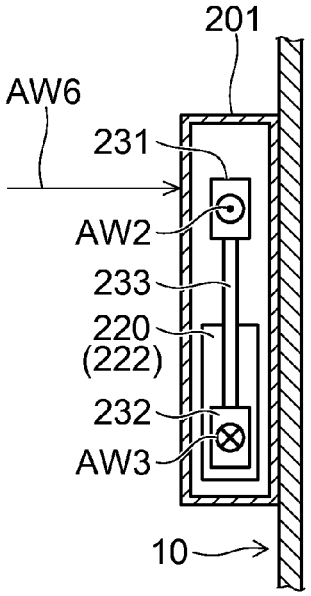
Figure 3C:
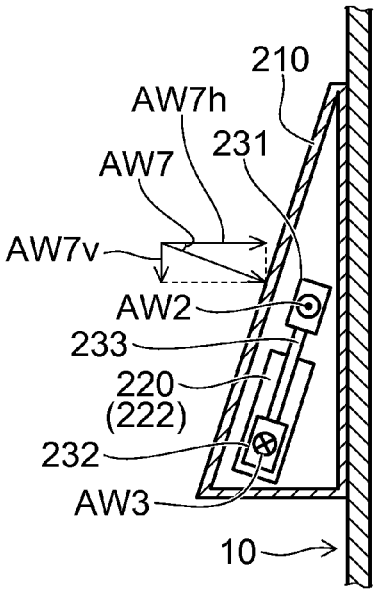

FIGS. 3A to 3C are schematic views showing the remote control device according to this embodiment.

FIG. 3A is a schematic plan view showing the remote control device according to this embodiment. FIG. 3B is a schematic sectional view taken along cross section A-A shown in FIG. 3A. FIG. 3C is a schematic sectional view showing a variation of the remote control device according to this embodiment. FIG. 3C corresponds to the schematic sectional view taken along cross section A-A shown in FIG. 3A.

As shown in FIGS. 2 and 3A, the remote control device 200 includes an operation button 210, a remote control body 201 supporting the operation button 210, and a power generator 220 provided inside the remote control body 201. The operation button 210 includes a main button group 210*m* and a sub button group 210*s*.

The main button group 210*m* includes e.g. a bottom wash button 211, a bidet wash button 212, a dry button 213, and a stop button 214.

The bottom wash button 211 is a button for instructing the toilet device 100 to start bottom washing. The bidet wash button 212 is a button for instructing the toilet device 100 to start bidet washing. The dry button 213 is a button for instructing the toilet device 100 to start private part drying. The stop button 214 is a button for instructing the toilet device 100 to stop the sanitary washing function or the private part drying function. That is, in this example, the bottom wash button 211 and the bidet wash button 212 are jet buttons for causing jetting from the nozzle 130. The stop button 214 stops jetting from the nozzle 130.

Thus, the main button group 210*m* includes operation buttons 210 for instructing the toilet device 100 to perform and stop various functions such as sanitary washing and private part drying.

The sub button group 210*s* includes e.g. a jet flow increase button 215, a jet flow decrease button 216, a wash position forward button 217, and a wash position backward button 218.

The jet flow increase button 215 is a button for inputting to the toilet device 100 an instruction for strengthening the force of water squirted during sanitary washing. The jet flow decrease button 216 is a button for inputting to the toilet device 100 an instruction for weakening the force of water squirted during sanitary washing. The wash position forward button 217 is a button for inputting to the toilet device 100 an instruction for advancing the wash position (the position of the nozzle 130). The wash position backward button 218 is a button for inputting to the toilet device 100 an instruction for retracting the wash position.

Thus, the sub button group 210*s* includes operation buttons 210 for instructing the toilet device 100 to change the state of various functions.

The buttons included in the main button group 210*m* and the sub button group 210*s* are not limited to the foregoing. For instance, the sub button group 210*s* may include buttons for instructing the toilet device 100 to change the temperature of water and drying air.

The power generator 220 generates power in response to the push operation of the operation button 210. In the case where the operation button 210 includes a plurality of buttons as shown in FIGS. 2 and 3A, the power generator 220 generates power in response to the push operation of one button of the operation buttons 210. The power generator 220 includes e.g. a motor. The power generator 220 transfers the operation force associated with the push operation of the operation button 210 to the rotary shaft of the motor and rotates the rotary shaft. Thus, the power generator 220 generates AC power from the motor. The power generation scheme of the power generator 220 is not limited to the motor, but may be an arbitrary scheme capable of supplying necessary power. The power outputted from the power generator 220 may be DC or pulsating.

Thus, the term "power generator" in this specification refers to a section for generating power in response to kinetic energy, or converting kinetic energy to electric energy. The power generation scheme of the power generator 220 can be e.g. an electromagnetic induction scheme or piezoelectric scheme.

The power generator 220 includes a main module 221 and a movable part 222. The movable part 222 moves between a projected position projected from the main module 221 and a pushed position pushed into the main module 221. The movable part 222 is held at the projected position by e.g. a spring, not shown, when not operated. When the movable part 222 moves from the projected position to the pushed position, the power generator 220 generates power by the operation force associated with the movement of the movable part 222.

As shown in FIG. 3A, a transfer mechanism 230 is provided between the operation button 210 and the power generator 220. The transfer mechanism 230 transfers the operation force associated with the push operation of the operation button 210 to the power generator 220. Thus, the operation force associated with the push operation of any button of the operation buttons 210 is transferred to the power generator 220. Accordingly, the power generator 220 generates power. Thus, the remote control device 200 can generate power by one power generator 220 even in the case where the operation button 210 includes a plurality of buttons.

The transfer mechanism 230 includes e.g. a first transfer section 231, a second transfer section 232, and a junction member 233. The first transfer section 231 receives the operation force of each button of the main button group 210*m* (in the example shown in FIGS. 2 and 3A, each of the bottom wash button 211, the bidet wash button 212, the dry button 213, and the stop button 214). The junction member 233 is connected to the first transfer section 231 and the second transfer section 232 and joins the first transfer section 231 with the second transfer section 232. The second transfer section 232 receives the operation force from the first transfer section 231.

The first transfer section 231 transfers the operation force of each button of the main button group 210*m* to the second transfer section 232 through the junction member 233. The second transfer section 232 receives the operation force from the first transfer section 231 through the junction member 233 and transfers the operation force to the power generator 220. Alternatively, the second transfer section 232 receives the operation force of each button of the sub button group 210*s* (in the example shown in FIGS. 2 and 3A, each of the jet flow increase button 215, the jet flow decrease button 216, the wash position forward button 217, and the wash position backward button 218). The second transfer section 232 transfers the operation force to the power generator 220.

The first transfer section 231 is opposed to each button of the main button group 210*m*. The second transfer section 232 is opposed to each operation button 210 of the sub button group 210*s*. The second transfer section 232 is placed at a position opposed to the movable part 222 of the power generator 220 in the longitudinal direction.

The first transfer section 231 is attached slidably in a direction generally parallel to the wall surface 10 as indicated by arrow AW1 shown in FIG. 3A and arrow AW2 shown in FIGS. 3A and 3B. The second transfer section 232 is attached slidably in a direction generally parallel to the wall surface 10 as indicated by arrow AW3 shown in FIGS. 3A and 3B and arrow AW4 shown in FIG. 3A. That is, the first transfer section 231 and the second transfer section 232 are what is called slide bars. The first transfer section 231 and the second transfer section 232 are connected to each other by the junction member 233. Thus, the first transfer section 231 and the second transfer section 232 are slid in an interlocked manner.

When one of the buttons of the main button group 210*m* is pushed, the operation force is transferred to the first transfer section 231. Then, the first transfer section 231 is slid in the direction of arrow AW2 (the direction generally parallel to the wall surface 10) shown in FIGS. 3A and 3B. When the first transfer section 231 is slid in the direction of arrow AW2 shown in FIGS. 3A and 3B, the junction member 233 rotates in the direction of arrow AW5 shown in FIG. 3A about the axis 233*a*. Then, the second transfer section 232 is slid in the direction of arrow AW3 (the direction generally parallel to the wall surface 10) shown in FIGS. 3A and 3B. The second transfer section 232 abuts on the movable part 222 of the power generator 220. Thus, the second transfer section 232 moves the movable part 222 from the projected position to the pushed position. Accordingly, the power generator 220 generates power by the push operation of each button of the main button group 210*m*.

When one of the buttons of the sub button group 210*s* is pushed, the operation force is transferred to the second transfer section 232. Then, the second transfer section 232 is slid in the direction of arrow AW3 shown in FIGS. 3A and 3B. When the second transfer section 232 is slid in the direction of arrow AW3 shown in FIGS. 3A and 3B, the second transfer section 232 abuts on the movable part 222 of the power generator 220. Thus, the second transfer section 232 moves the movable part 222 from the projected position to the pushed position. Accordingly, the power generator 220 generates power by the push operation of each button of the sub button group 210*s*.

The remote control device 200 further includes a click mechanism 228. The click mechanism 228 provides a click feeling to the pushed operation button 210.

In the remote control device 200 shown in FIGS. 2 and 3A, the click mechanism 228 is provided in the power generator 220. In the power generator 220, for instance, when the movable part 222 is pushed against the elastic force of e.g. a spring, an interlock member engaged with the movable part 222 moves. Then, when the movable part 222 moves to the pushed position, the click mechanism 228 temporarily disengages the engagement state between the interlock member and the movable part 222. Thus, the interlock member returns to the initial position by the elastic force. At this time, the operation force of the operation button 210 is weakened and propagated to the user as a click feeling.

The interlock member is joined to the rotary shaft of the motor through a gear and the like. The rotary shaft is rotated by the momentum of the interlock member returning to the initial position and generates power. The power generator 220 generates power by the movement of the movable part 222 to the pushed position when the operation button 210 is pushed. When the power generator 220 generates power, a click feeling is provided to the pushed operation button 210. In this configuration, for instance, the amount of power generation can be controlled by the elastic force applied to the interlock member independent of e.g. the speed of the push operation of the user. This can suppress e.g. variation in the amount of power generation between the operations. A stable amount of power generation can be obtained in the power generator 220.

In this example, the click mechanism 228 doubles as part of the power generation mechanism of the power generator 220. The click mechanism 228 does not necessarily need to be provided in the power generator 220, but may be provided separately from the power generator 220.

Here, when the movable part 222 of the power generator 220 moves to the pushed position, a relatively large sound may occur. For instance, the click mechanism 228 temporarily disengages the engagement state between the interlock member and the movable part 222. Thus, the interlock member returns to the initial position by the elastic force. Then, a relatively large sound may occur.

In general, the remote control device 200 is placed on the wall surface 10 of a toilet room so that the user seated on the toilet seat 124 can easily operate the operation button 210. Thus, as indicated by arrow AW6 shown in FIG. 3B, the direction of the push operation (pressed direction) of the operation button 210 is generally perpendicular to the wall surface 10. In other words, the operation button 210 includes a button with the direction of the push operation being generally perpendicular to the wall surface 10. Alternatively, as indicated by arrow AW7 and arrow AW7*h* shown in FIG. 3C, the direction of the push operation of the operation button 210 has a component generally perpendicular to the wall surface 10. In other words, the operation button 210 includes a button with the direction of the push operation having a component generally perpendicular to the wall surface 10.

Thus, the direction of the push operation of the operation button has a component generally perpendicular to the wall surface. Accordingly, the sound produced by the movable part of the power generator moved to the pushed position may propagate through the wall surface to e.g. the adjacent toilet room of a plurality of toilet rooms placed consecutively. Then, the user of the adjacent toilet room may erroneously think that the remote control device is automatically operated without his/her operation. Alternatively, the user of the adjacent toilet room may be annoyed with the sound of the power generator propagated through the wall surface of the toilet room. Alternatively, the user of the adjacent toilet room may erroneously think that the remote control device is faulty.

In contrast, in the remote control device 200 according to this embodiment, in the state of the remote control device 200 placed on the wall surface 10 of the toilet room, the pushed direction of the movable part 222 of the power generator 220 is generally parallel to the wall surface 10 as indicated by arrow AW3 shown in FIGS. 3A and 3B. In other words, in the state of the remote control device 200 placed on the wall surface 10 of the toilet room, the pressed direction of the movable part 222 of the power generator 220 is generally parallel to the wall surface 10.

According to this embodiment, the movable part 222 of the power generator 220 is pushed in a direction generally parallel to the wall surface 10. Thus, the sound produced by the movable part 222 of the power generator 220 moved to the pushed position is likely to propagate generally in parallel to the wall surface 10. Accordingly, the energy of the movable part 222 of the power generator 220 being pushed is less likely to propagate to the wall surface 10. This can suppress vibration propagated from the remote control device 200 to the wall surface 10. Furthermore, this can suppress the sound propagated from the remote control device 200 to the wall surface 10.

In this embodiment, the first transfer section 231 and the second transfer section 232 move in a direction generally parallel to the wall surface 10 in response to the push operation of the operation button 210. The second transfer section 232 pushes the movable part 222 of the power generator 220. Thus, the movable part 222 of the power generator 220 can be pushed in a relatively simple configuration.

In this embodiment, the direction of the push operation of the operation button 210 has a component generally perpendicular to the wall surface 10. Thus, the movable part 222 of the power generator 220 can be pushed by the same method as the method for operating a conventional remote control device.

The junction member 233 of this embodiment undergoes a rotational action in response to the push operation of the operation button 210. Thus, the junction member 233 slides the first transfer section 231 and the second transfer section 232. Accordingly, the junction member 233 can move the first transfer section 231 and the second transfer section 232 even in a relatively narrow area. This can downsize the remote control device 200.

The remote control device 200 of this embodiment is further described with reference to the drawings.

Figure 4:
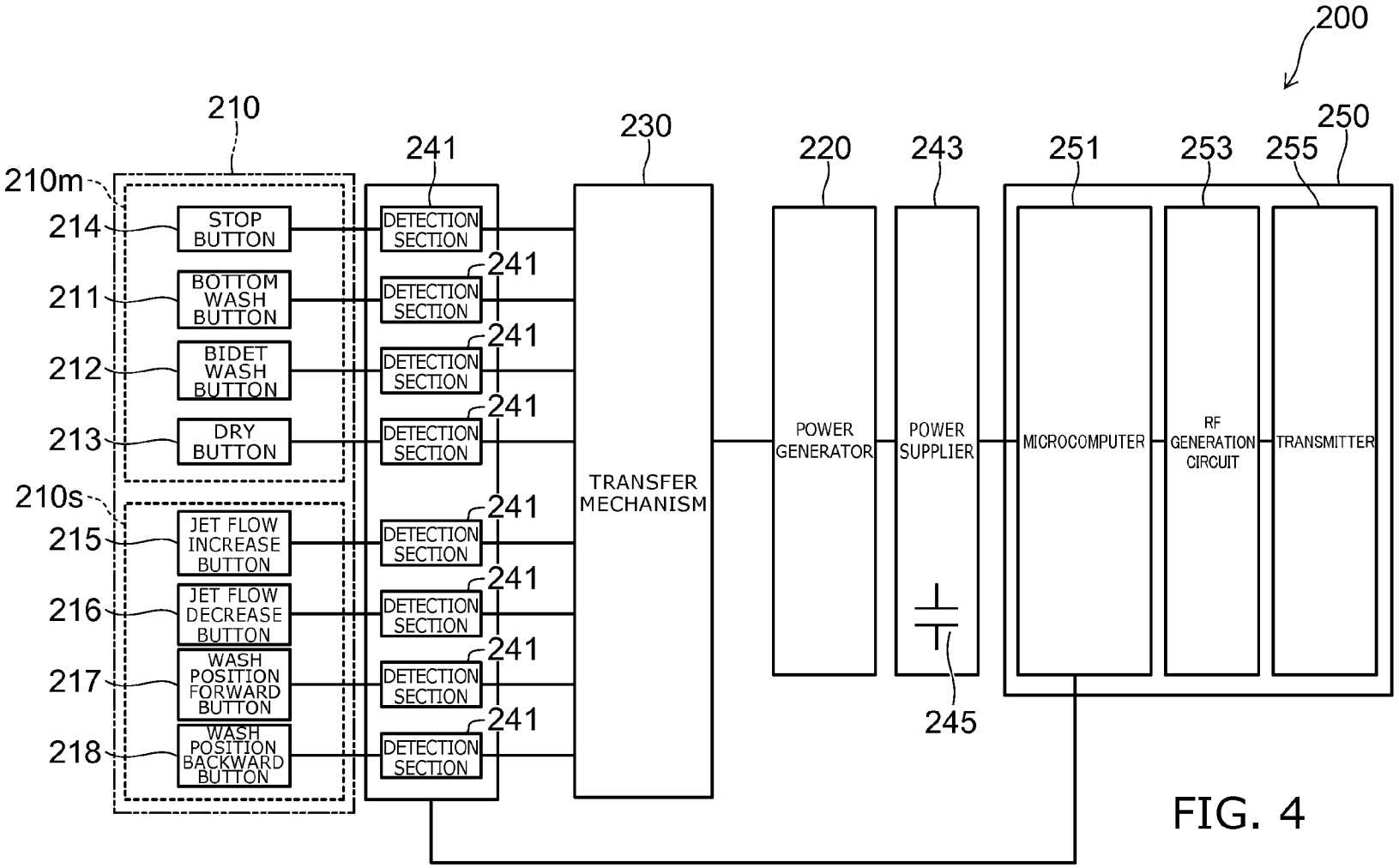
FIG. 4 is a block diagram showing the remote control device according to this embodiment.

FIG. 4 is a block diagram showing the remote control device according to this embodiment.

As shown in FIG. 4, the remote control device 200 includes an operation button 210, a plurality of detection sections 241, a transfer mechanism 230, a power generator 220, a power supplier 243, and a controller 250. The operation button 210, the transfer mechanism 230, and the power generator 220 are as described above with reference to FIGS. 2 to 3C.

The plurality of detection sections 241 are associated respectively with a plurality of buttons included in the operation button 210. The plurality of detection sections 241 detect the push operation of the plurality of buttons, respectively. Each detection section 241 is based on e.g. a Hall element. Each detection section 241 may be e.g. a mechanical switch. A specific example of the detection section 241 will be described later.

The controller 250 is electrically connected to each of the plurality of detection sections 241. The controller 250 determines the pushed operation button 210 based on the detection result of each of the plurality of detection sections 241. The controller 250 transmits a wireless signal corresponding to the determined operation button 210 toward the toilet device 100. Thus, the controller 250 remotely controls the toilet device 100.

For instance, when the controller 250 determines the push operation of the bottom wash button 211, the controller 250 transmits a wireless signal indicating to start bottom washing to the toilet device 100. The toilet device 100 receives the wireless signal from the remote control device 200 and performs processing corresponding to the wireless signal. For instance, the toilet device 100 receives the wireless signal indicating to start bottom washing. In response thereto, the toilet device 100 advances the nozzle 130 into the bowl section and starts jetting from the nozzle 130.

For instance, the controller 250 transmits the same wireless signal to the toilet device 100 a plurality of times. The controller 250 transmits the same wireless signal to the toilet device 100 e.g. three times. This can suppress e.g. communication errors between the remote control device 200 and the toilet device 100.

The controller 250 includes e.g. a microcomputer 251, a radio frequency generation circuit 253, and a transmitter 255. The microcomputer 251 performs e.g. determination of the pushed operation button 210 and generation of a signal corresponding to the determined operation button 210. The radio frequency generation circuit 523 converts e.g. the signal generated by the microcomputer 251 to a radio frequency signal. The radio frequency generation circuit 253 generates e.g. a 2.4-GHz radio frequency signal. The transmitter 255 includes e.g. an antenna. The transmitter 255 converts the radio frequency signal generated by the radio frequency generation circuit 253 to a wireless signal and transmits it to the toilet device 100.

The controller 250 transmits a 2.4-GHz wireless signal to the toilet device 100. In wireless communication using the 2.4-GHz band, there is no need to provide the remote control body 201 with a transmission window (what is called the black window) for radio waves as in the case of e.g. infrared communication. This can improve e.g. the designability of the remote control device 200. Furthermore, wireless communication using the 2.4-GHz band is less susceptible to obstacles than infrared communication. This can also improve the quality of communication with the toilet device 100.

The microcomputer 251, the radio frequency generation circuit 253, and the transmitter 255 may be housed in one chip, or separated as different elements. The communication between the remote control device 200 and the toilet device 100 is not limited to the foregoing, but may be arbitrary. The configuration of the controller 250 is not limited to the foregoing, but may be an arbitrary configuration enabling e.g. determination of the operation button 210 and wireless communication with the toilet device 100.

The power supplier 243 includes an electric storage element 245 for storing power generated by the power generator 220. When the voltage of the electric storage element 245 becomes more than or equal to a prescribed value, the power supplier 243 supplies the power stored in the electric storage element 245 to the controller 250 and activates the controller 250. The electric storage element 245 is based on e.g. a capacitor or storage battery.

Here, "when the voltage of the electric storage element 245 becomes more than or equal to a prescribed value" means e.g. when the power necessary for activating the controller 250 and transmitting a wireless signal is stored in the electric storage element 245. In the case where the controller 250 transmits a wireless signal a plurality of times, it means when the power necessary for activating the controller 250 and transmitting a wireless signal a plurality of times is stored in the electric storage element 245. Thus, the prescribed value of the voltage of the electric storage element 245 is set depending on the power consumption in the controller 250. The prescribed value is e.g. 3.5 V. In other words, "when the voltage of the electric storage element 245 becomes more than or equal to a prescribed value" means when the integral amount of power of the power generator 220 becomes more than or equal to the prescribed value.

The capacity of the electric storage element 245 is set to e.g. the minimum capacity capable of storing the power necessary for activating the controller 250 and transmitting a wireless signal. This can suppress e.g. upsizing of the electric storage element 245. Furthermore, this can suppress e.g. malfunctions of the controller 250 due to excess power remaining in the electric storage element 245.

Next, a specific example of the remote control device according to this embodiment is described with reference to the drawings.

Figure 5:
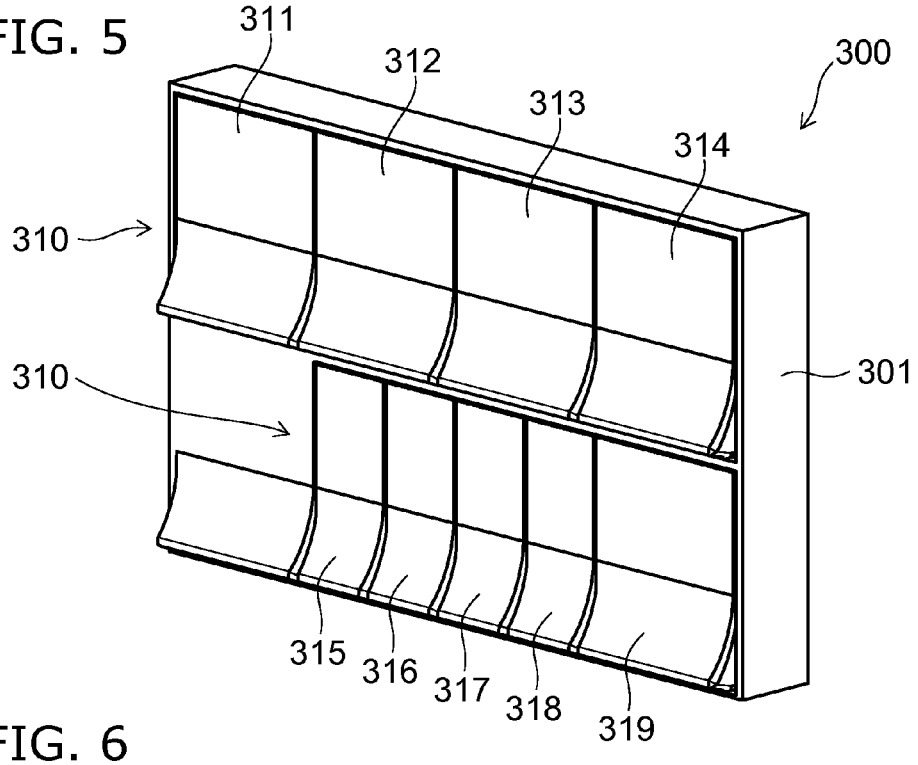
FIG. 5 is a schematic perspective view showing a specific example of the remote control device according to this embodiment.

FIG. 5 is a schematic perspective view showing a specific example of the remote control device according to this embodiment.

Figure 6:
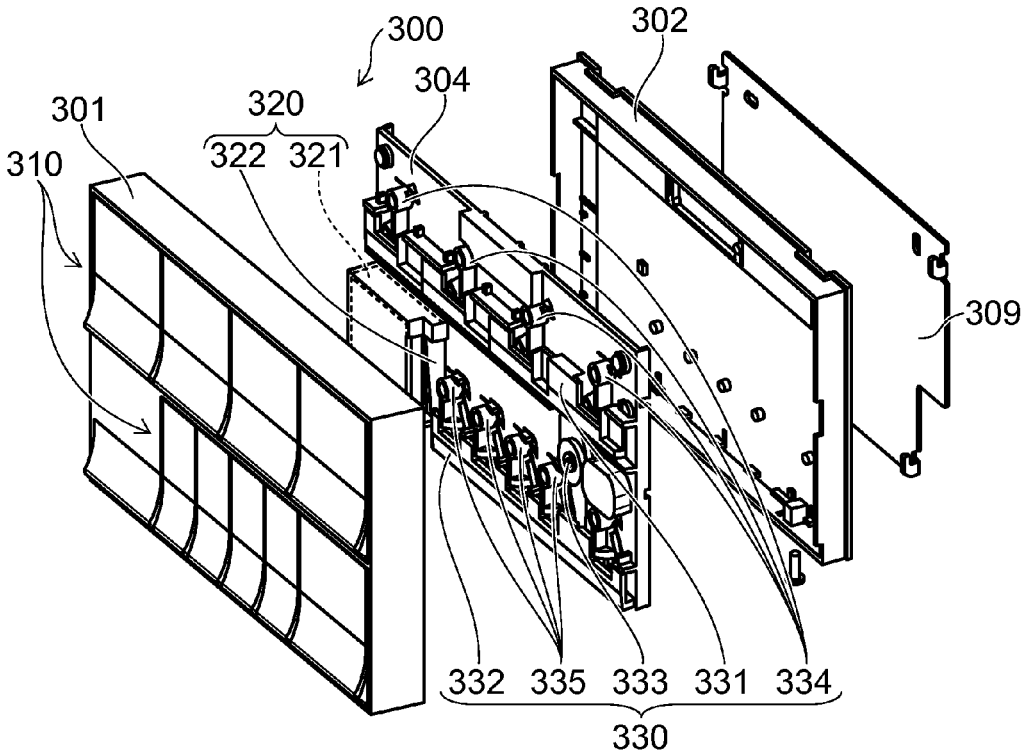
FIG. 6 is a schematic exploded view showing the remote control device of this specific example.

FIG. 6 is a schematic exploded view showing the remote control device of this specific example.

Figure 7:
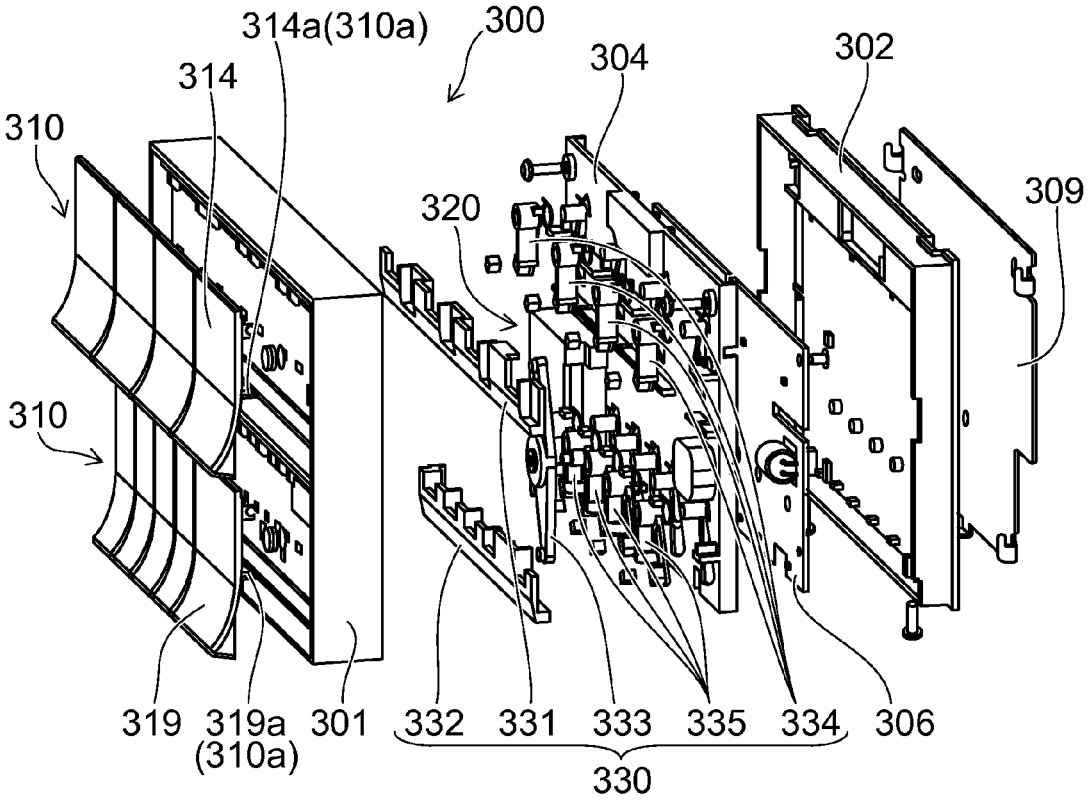
FIG. 7 is an alternative schematic exploded view showing the remote control device of this specific example.

FIG. 7 is an alternative schematic exploded view showing the remote control device of this specific example.

The remote control device 300 of this specific example includes a first casing (remote control body) 301, a second casing (remote control body) 302, a base 304, a substrate 306, an operation button 310, a power generator 320, and a transfer mechanism (link mechanism) 330.

The operation button 310 includes a plurality of buttons. As shown in FIG. 5, the operation button 310 of this specific example includes a first button 311, a second button 312, a third button 313, a fourth button 314, a fifth button 315, a sixth button 316, a seventh button 317, an eighth button 318, and a ninth button 319. The number of buttons included in the operation button 310 is not limited thereto. For instance, the first button 311 corresponds to the bottom wash button 211 described above with reference to FIGS. 2 to 3C. For instance, the second button 312 corresponds to the bidet wash button 212 described above with reference to FIGS. 2 to 3C.

The operation button 210 is provided in the first casing 301 and includes a pushing part 310*a*. As shown in FIG. 7, the fourth button 314 includes a pushing part 314*a*. The ninth button 319 includes a pushing part 319*a*.

The power generator 320 is provided on the base 304. The power generator 320 includes a main module 321 and a movable part 322. The power generator 320 of this specific example is similar to the power generator 220 described above with reference to FIGS. 2 to 3C.

On the base 304, the transfer mechanism 330 is provided between the operation button 310 and the power generator 320. The transfer mechanism 330 includes a main link 331, a sub link 332, a junction arm 333, a main rotary cam (receiving part) 334, and a sub rotary cam (receiving part) 335. The transfer mechanism 330 transfers the operation force associated with the push operation of the operation button 310 to the power generator 320. The main link 331 corresponds to the first transfer section 231 described above with reference to FIGS. 2 to 3C. The sub link 332 corresponds to the second transfer section 232 described above with reference to FIGS. 2 to 3C. The junction arm 333 corresponds to the junction member 233 described above with reference to FIGS. 2 to 3C.

The substrate 306 is fixed to the base 304. The power supplier 243 and the controller 250 described above with reference to FIG. 4 are provided on the substrate 306. The base 304 is fixed to the second casing 302 with the power generator 320, the transfer mechanism 330, and the substrate 306 held on the base 304. That is, the power generator 320, the transfer mechanism 330, and the substrate 306 are fixed to the second casing 302 via the base 304. The power generator 320, the transfer mechanism 330, and the substrate 306 are not fixed directly to the second casing 302. The base 304 is provided between the first casing 301 and the second casing 302. In other words, the base 304 is provided inside the remote control body 201. The first casing 301 and the second casing 302 correspond to the remote control body 201 described above with reference to FIGS. 2 to 3C.

The remote control device 300 of this specific example is placed on the wall surface 10 (see, e.g., FIG. 1) of the toilet room by a hanger 309. The hanger 309 is formed from e.g. metal. The remote control device 300 of this specific example may be placed directly on the wall surface 10 of the toilet room by a hanger 309 without the intermediary of the hanger 309. According to this specific example, the power generator 320 is not fixed to the second casing 302, but fixed to the base 304. This can further suppress the vibration and sound propagated from the remote control device 200 to the wall surface 10.

Figure 8A:
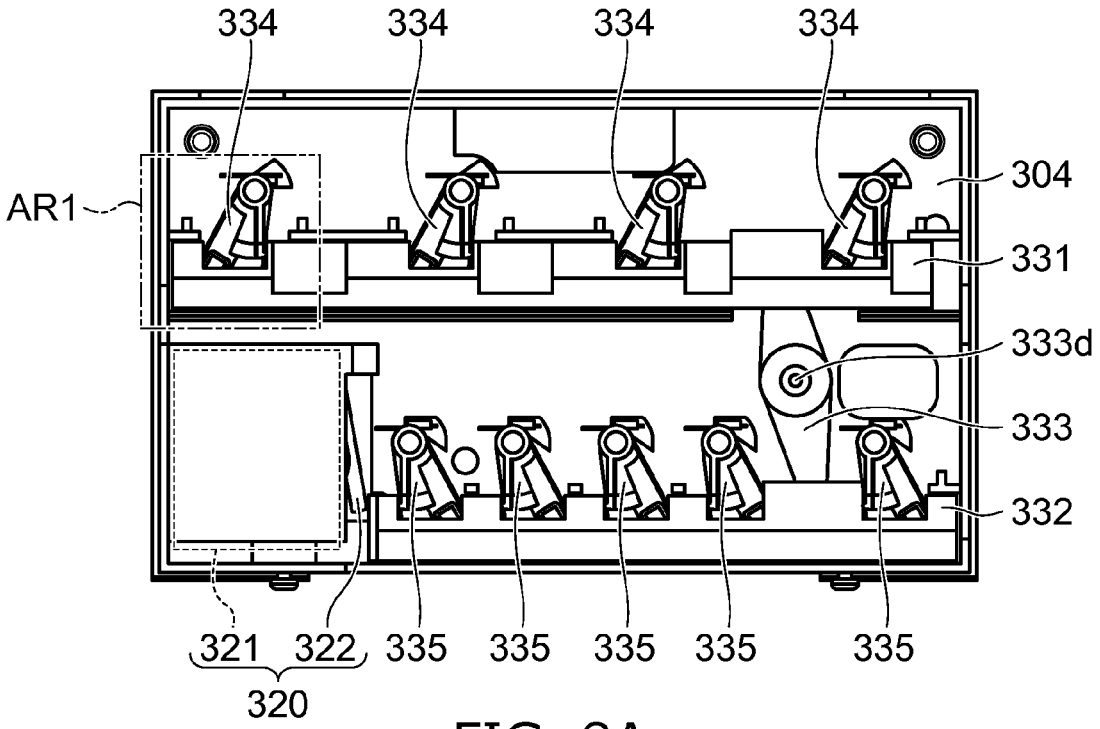
FIGS. 8A and 8B are schematic plan views for describing the action of the transfer mechanism of this specific example.
Figure 8B:
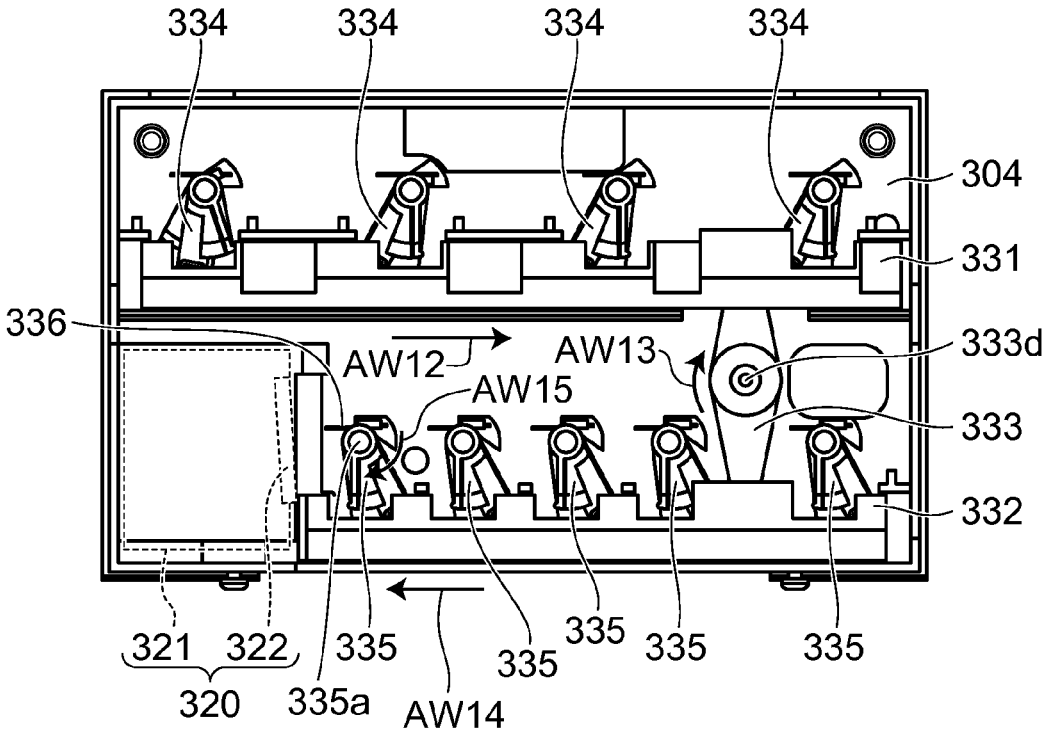

FIGS. 8A and 8B are schematic plan views for describing the action of the transfer mechanism of this specific example.

Figure 9:
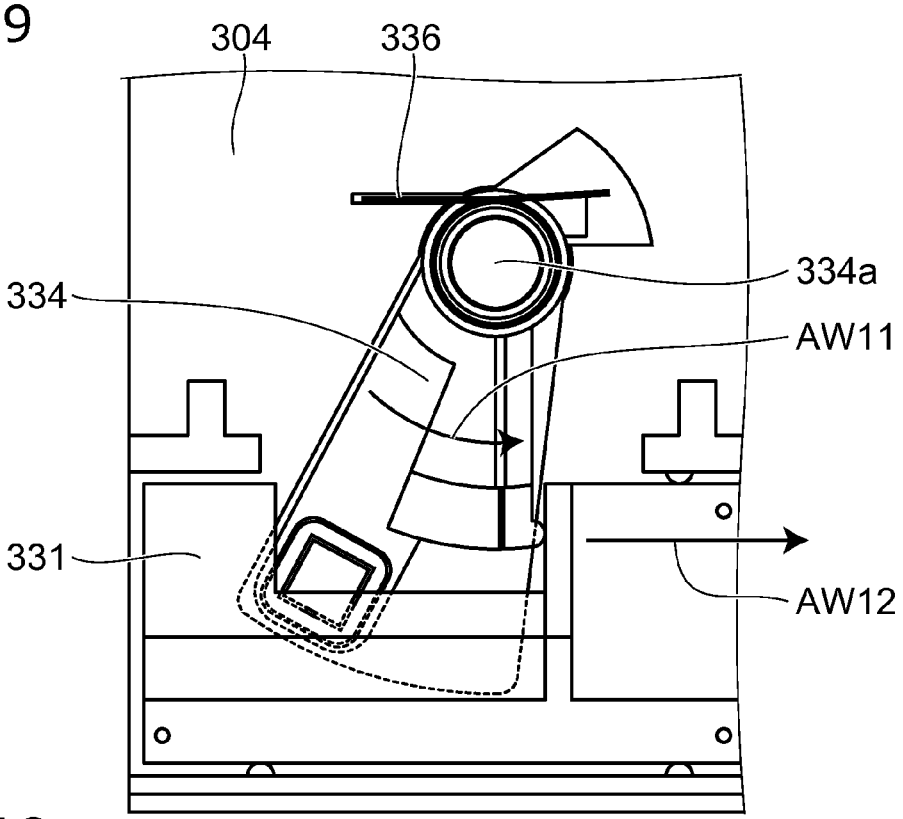
FIG. 9 is a schematic enlarged view enlarging region AR1 shown in FIG. 8A.

FIG. 9 is a schematic enlarged view enlarging region AR1 shown in FIG. 8A.

FIG. 8A is a schematic plan view showing the state of the transfer mechanism before the push operation of the operation button. FIG. 8B is a schematic plan view showing the state of the transfer mechanism after the push operation of the operation button. In FIGS. 8A and 8B, the first casing 301 and the operation button 310 are not shown for convenience of description.

As shown in FIG. 8A, before the push operation of the operation button 310, the movable part 322 is located at the projected position projected from the main module 321. At this time, each button of the operation button 310 is in the off-state. The power generator 320 does not generate power.

As shown in FIG. 9, a spring 336 is provided around the shaft 334*a*. For instance, the spring 336 can be e.g. a torsion coil spring. The main rotary cam 334 can rotate about the shaft 334*a* while receiving the elastic force of the spring 336. The main rotary cam 334 is held at the ordinary position shown in FIG. 9 by the spring 336 before the push operation of the operation button 310. The structure of the sub rotary cam 335 is similar to the structure of the main rotary cam 334.

Next, the push operation of the first button 311 of the operation button 310 by e.g. a user is taken as an example in the following description. When e.g. a user pushes the first button 311, the operation force is transferred from the pushing part 310*a* (see FIG. 7) of the operation button 310 to the main rotary cam 334. Then, the main rotary cam 334 receives the operation force and rotates in the direction of arrow AW11 shown in FIG. 9 about the shaft 334*a* against the elastic force of the spring 336. When the main rotary cam 334 rotates in the direction of arrow AW11 shown in FIG. 9, the main rotary cam 334 pushes the main link 331 in the direction of arrow AW12 shown in FIGS. 9 and 8B. Thus, the main link 331 moves in the direction of arrow AW12 shown in FIGS. 9 and 8B (the direction generally parallel to the wall surface 10).

The main link 331 and the sub link 332 are connected to each other by the junction arm 333. Thus, the main link 331 and the sub link 332 are moved in an interlocked manner. Accordingly, when the main link 331 moves in the direction of arrow AW12 shown in FIGS. 9 and 8B, the junction arm 333 rotates in the direction of arrow AW13 shown in FIG. 8B about the shaft 333*d*. Then, the sub link 332 moves in the direction of arrow AW14 shown in FIG. 8B (the direction generally parallel to the wall surface 10).

The sub link 332 moves in the direction of arrow AW14 shown in FIG. 8B and moves the movable part 322 of the power generator 320 from the projected position to the pushed position. At this time, the pushed direction of the movable part 322 of the power generator 320 is generally parallel to the wall surface 10. In other words, in the state of the remote control device 300 placed on the wall surface 10 of the toilet room, the pressed direction of the movable part 322 of the power generator 320 is generally parallel to the wall surface 10. Thus, the power generator 320 generates power by the push operation of the first button 311. Also by the push operation of the second button 312, the third button 313, and the fourth button 314, the power generator 320 generates power based on a similar action of the transfer mechanism 330.

Next, the push operation of the fifth button 315 of the operation button 310 by e.g. a user is taken as an example in the following description.

The state before the push operation of the operation button 310 is as described above with reference to FIG. 8A.

When e.g. a user pushes the fifth button 315, the operation force is transferred from the pushing part 310*a* of the operation button 310 to the sub rotary cam 335. Then, the sub rotary cam 335 receives the operation force and rotates in the direction of arrow AW15 shown in FIG. 8B about the shaft 335*a* against the elastic force of the spring 336. When the sub rotary cam 335 rotates in the direction of arrow AW15 shown in FIG. 8B, the sub rotary cam 335 pushes the sub link 332 in the direction of arrow AW14 shown in FIG. 8B. Thus, the sub link 332 moves in the direction of arrow AW14 shown in FIG. 8B.

The sub link 332 moves in the direction of arrow AW14 shown in FIG. 8B and moves the movable part 322 of the power generator 320 from the projected position to the pushed position. Thus, the power generator 320 generates power by the push operation of the fifth button 315. Also by the push operation of the sixth button 316, the seventh button 317, the eighth button 318, and the ninth button 319, the power generator 320 generates power based on a similar action of the transfer mechanism 330.

The transfer mechanism 330 of this specific example is further described with reference to the drawings.

Figure 10:
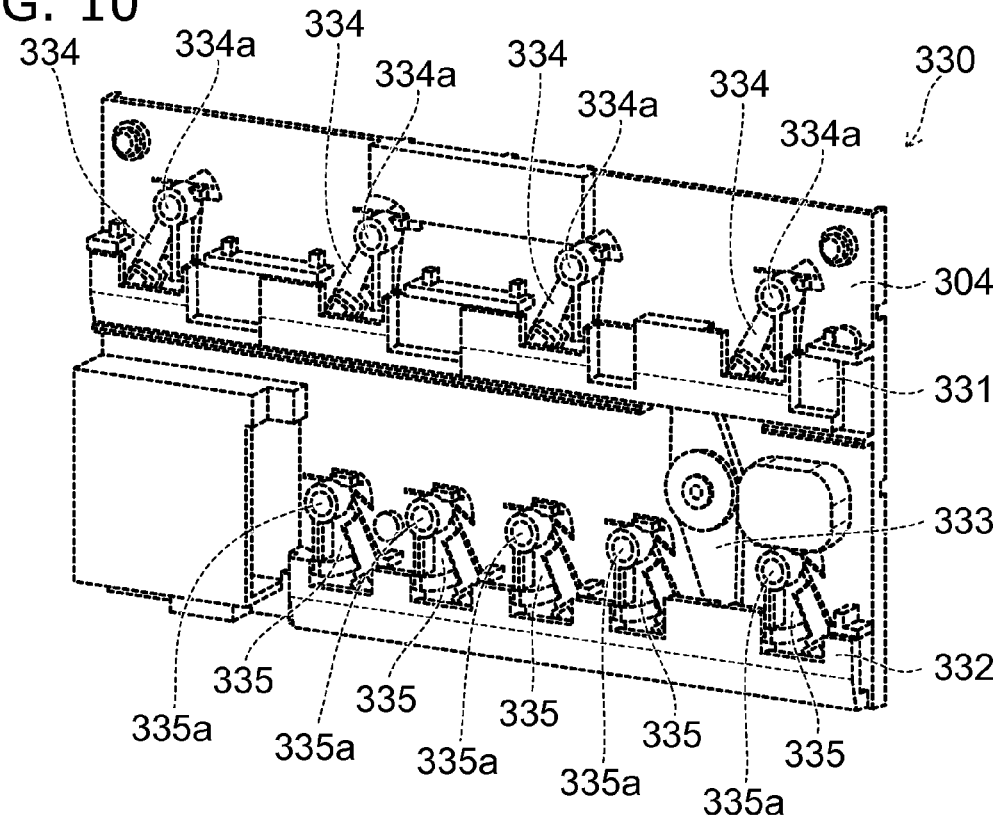
FIG. 10 is a schematic perspective view showing the base holding the transfer mechanism of this specific example.

FIG. 10 is a schematic perspective view showing the base holding the transfer mechanism of this specific example.

Figure 11:
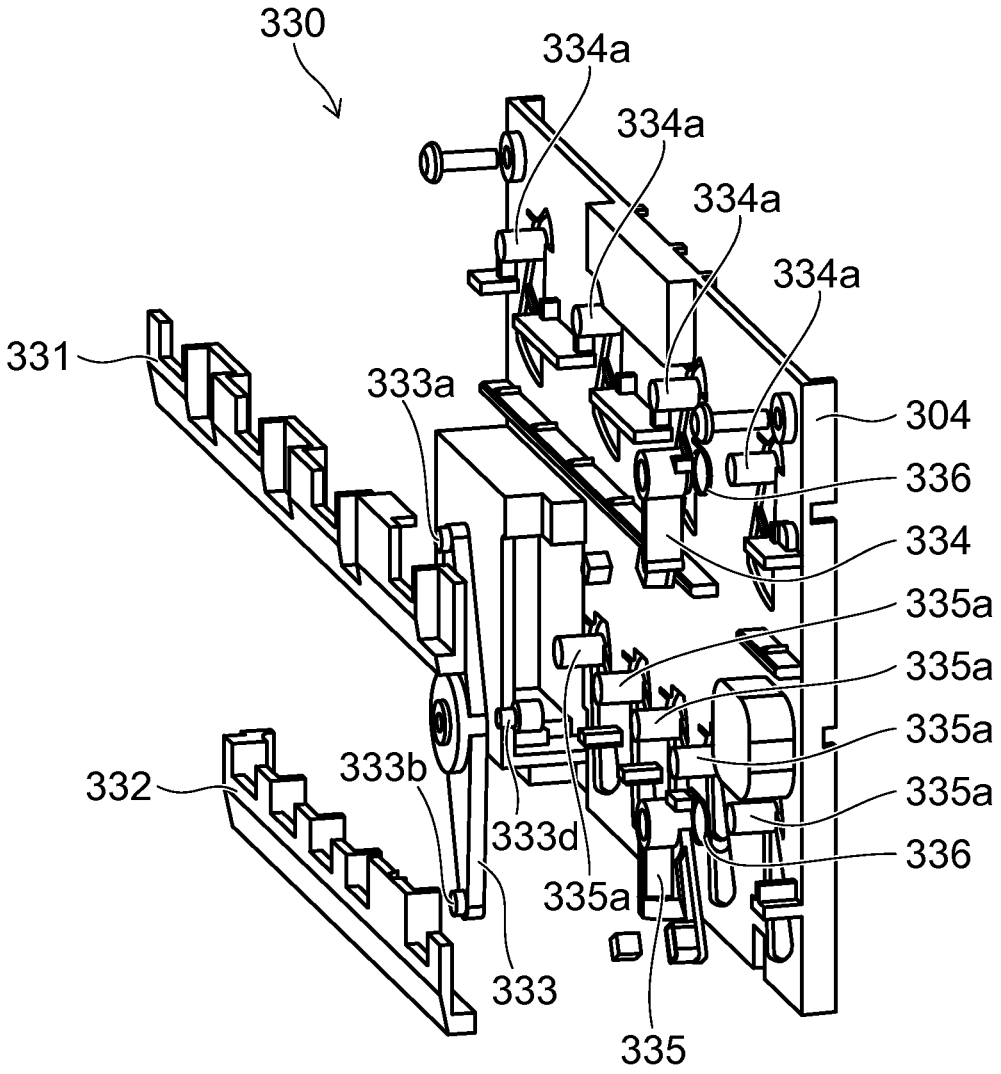
FIG. 11 is a schematic exploded view showing the transfer mechanism of this specific example in an exploded manner.

FIG. 11 is a schematic exploded view showing the transfer mechanism of this specific example in an exploded manner.

Figure 12A:
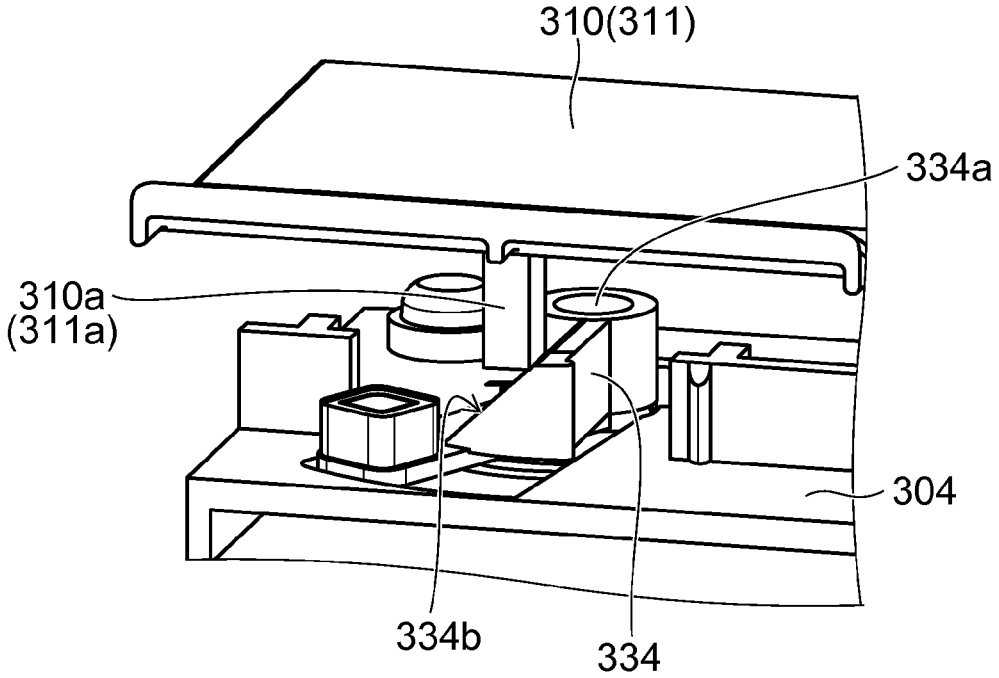
FIGS. 12A and 12B are schematic perspective views for describing the action of the operation button and the main rotary cam.
Figure 12B:
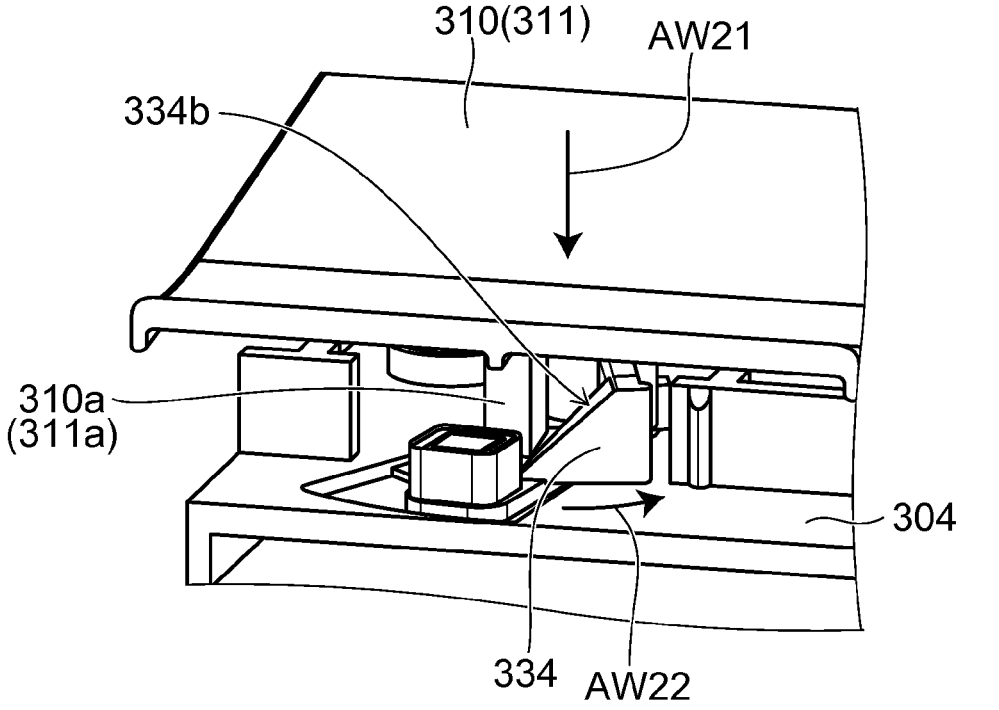

FIGS. 12A and 12B are schematic perspective views for describing the action of the operation button and the main rotary cam.

Figure 13A:
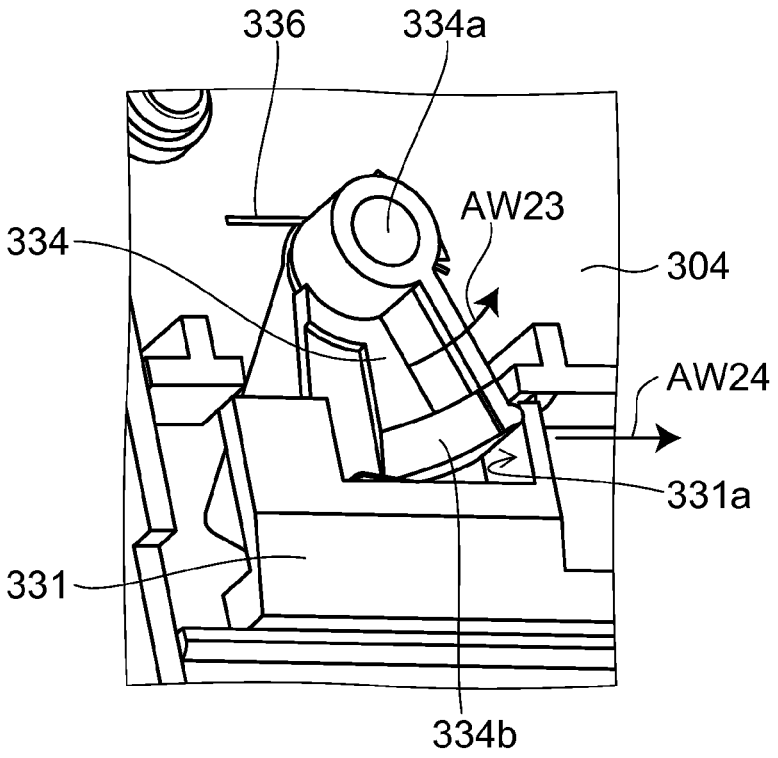
FIGS. 13A and 13B are schematic perspective views for describing the action of the main rotary cam and the main link.
Figure 13B:
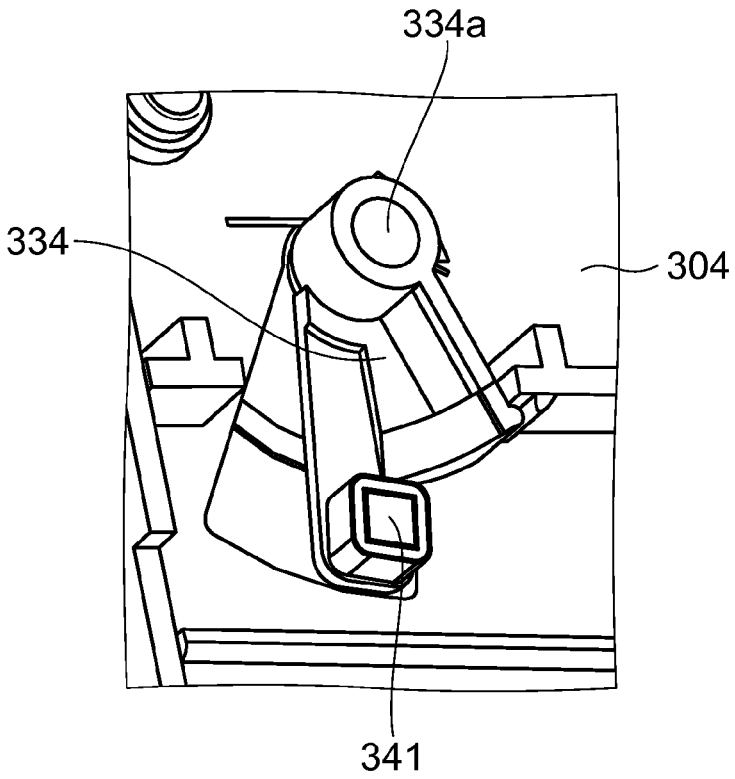

FIGS. 13A and 13B are schematic perspective views for describing the action of the main rotary cam and the main link.

Figure 14:
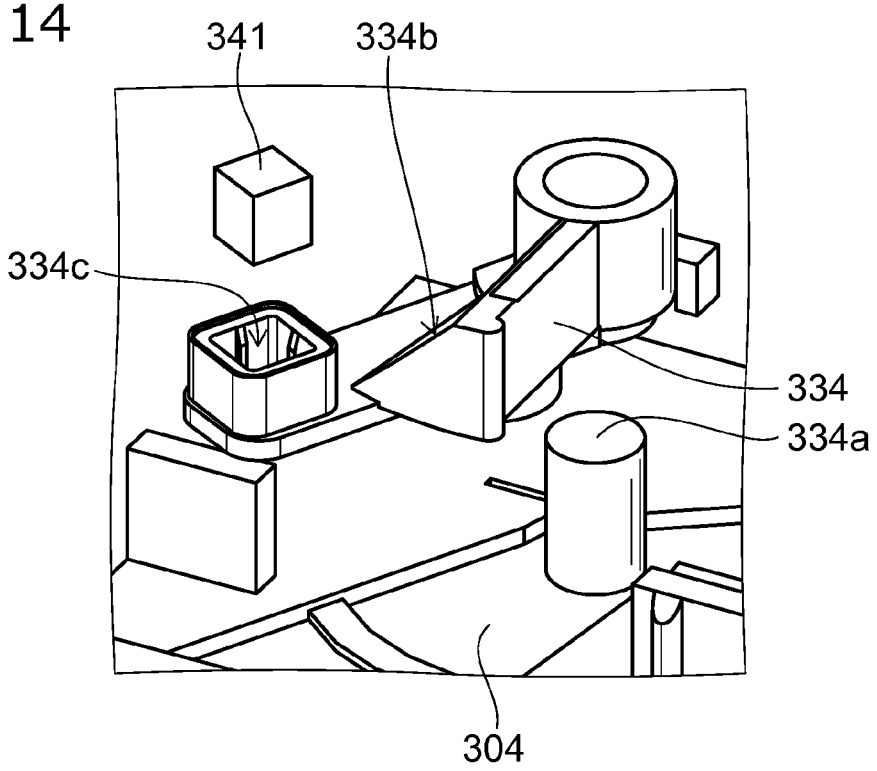
FIG. 14 is a schematic exploded view showing the main rotary cam of this specific example.

FIG. 14 is a schematic exploded view showing the main rotary cam of this specific example.

FIG. 12A is a schematic perspective view showing the state before the push operation of the operation button. FIG. 12B is a schematic perspective view showing the state after the push operation of the operation button.

FIGS. 13A and 13B are schematic perspective views showing the state after the push operation of the operation button. In FIG. 13B, the main link 331 is not shown for convenience of description.

As shown in FIGS. 10 and 11, the transfer mechanism 330 of this specific example includes a main link 331, a sub link 332, a junction arm 333, a main rotary cam 334, and a sub rotary cam 335. As shown in FIG. 11, a shaft 334*a* provided on the base 304 is inserted into the main rotary cam 334. Thus, the main rotary cam 334 can rotate about the shaft 334*a*. A shaft 335*a* provided on the base 304 is inserted into the sub rotary cam 335. Thus, the sub rotary cam 335 can rotate about the shaft 335*a*.

A spring 336 is provided around the shaft 334*a*. The main rotary cam 334 is held at the ordinary position shown in FIG. 10 by the spring 336 before the push operation of the operation button 310. A spring 336 is provided around the shaft 335*a*. The sub rotary cam 335 is held at the ordinary position shown in FIG. 10 by the spring 336 before the push operation of the operation button 310.

As shown in FIG. 11, the junction arm 333 includes a first protrusion 333*a* and a second protrusion 333*b*. The first protrusion 333*a* is engaged with the main link 331. The second protrusion 333*b* is engaged with the sub link 332. Thus, the main link 331 and the sub link 332 are connected to each other by the junction arm 333.

Here, the push operation of the first button 311 of the operation button 310 by e.g. a user is taken as an example in the following description. As shown in FIG. 12A, before the push operation of the first button 311, the pushing part 311*a* of the first button 311 lies on the receiving surface 334*b* of the main rotary cam 334.

Next, e.g. a user pushes the first button 311 as indicated by arrow AW21 shown in FIG. 12B. Then, the pushing part 311*a* of the first button 311 pushes the receiving surface 334*b* of the main rotary cam 334 in the direction of arrow AW21 shown in FIG. 12B. As shown in FIGS. 12B and 13A, the receiving surface 334*b* of the main rotary cam 334 is inclined with respect to the direction of the push operation of the operation button 310 (the direction of arrow AW21). Thus, the main rotary cam 334 rotates about the shaft 334*a* in the direction of arrow AW22 shown in FIG. 12B and the direction of arrow AW23 shown in FIG. 13A.

Then, as shown in FIG. 13A, the main rotary cam 334 pushes the inner surface 331*a* of the main link 331 in the direction of arrow AW24 shown in FIG. 13A. Thus, the main link 331 moves in the direction of arrow AW24 shown in FIG. 13A (the direction generally parallel to the wall surface 10). Thus, the pushing part 311*a* of the first button 311 can smoothly move the main link 331 by pushing the receiving surface 334*b* of the main rotary cam 334.

As shown in FIGS. 13B and 14, a magnet 341 is held on the main rotary cam 334. More specifically, as shown in FIG. 14, the main rotary cam 334 includes a recess 334*c*. The magnet 341 is held in the recess 334*c* of the main rotary cam 334. The magnet 341 is one of the members included in the detection section 340 of this specific example. The details of the detection section 340 of this specific example will be described later.

Figure 15:
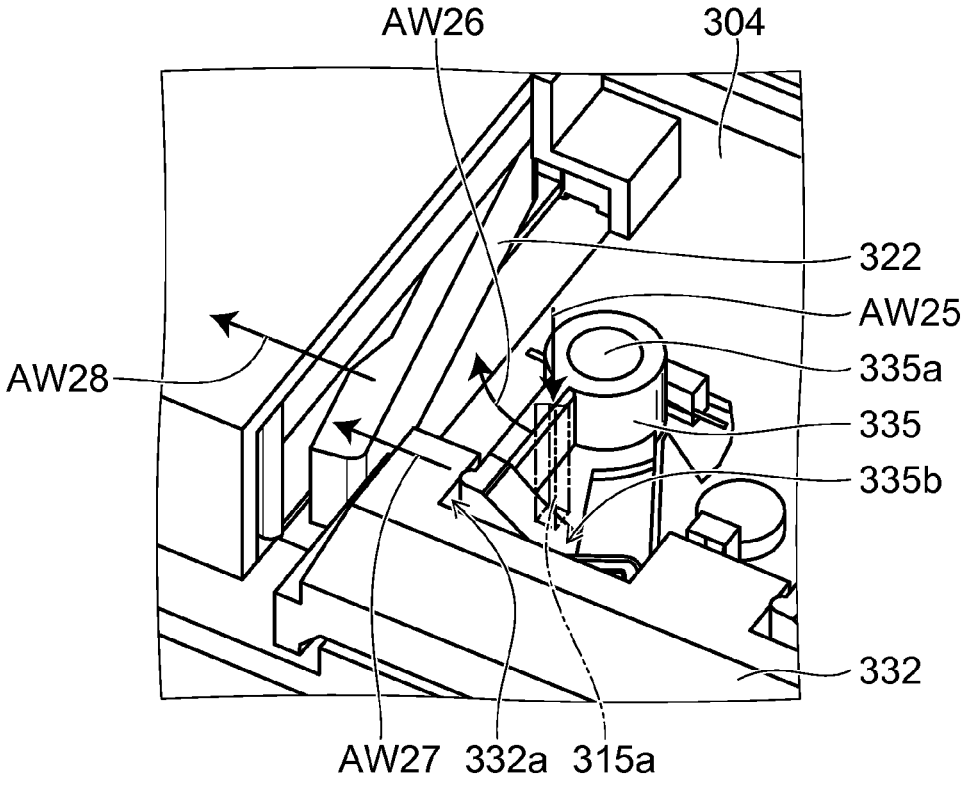
FIG. 15 is a schematic perspective view for describing the action of the sub rotary cam and the sub link.

FIG. 15 is a schematic perspective view for describing the action of the sub rotary cam and the sub link.

Here, the push operation of the fifth button 315 of the operation button 310 by e.g. a user is taken as an example in the following description. Before the push operation of the fifth button 315, the pushing part 315*a* of the fifth button 315 lies on the receiving surface 335*b* of the sub rotary cam 335.

Next, e.g. a user pushes the fifth button 315 as indicated by arrow AW25 shown in FIG. 15. Then, the pushing part 315*a* of the fifth button 315 pushes the receiving surface 335*b* of the sub rotary cam 335. As shown in FIG. 15, the receiving surface 335*b* of the sub rotary cam 335 is inclined with respect to the direction of the push operation of the operation button 310 (the direction of arrow AW25). Thus, the sub rotary cam 335 rotates about the shaft 335*a* in the direction of arrow AW26 shown in FIG. 15.

Then, the sub rotary cam 335 pushes the inner surface 332*a* of the sub link 332 in the direction of arrow AW27 shown in FIG. 15. Thus, the sub link 332 moves in the direction of arrow AW27 shown in FIG. 15 (the direction generally parallel to the wall surface 10). Thus, the pushing part 315*a* of the fifth button 315 can smoothly move the sub link 332 by pushing the receiving surface 335*b* of the sub rotary cam 335.

When the sub link 332 moves in the direction of arrow AW27 shown in FIG. 15, the sub link 332 moves the movable part 322 of the power generator 320 from the projected position to the pushed position as indicated by arrow AW28 shown in FIG. 15.

Next, the details of the members of the transfer mechanism 330 of this specific example are described with reference to the drawings.

Figure 16A:
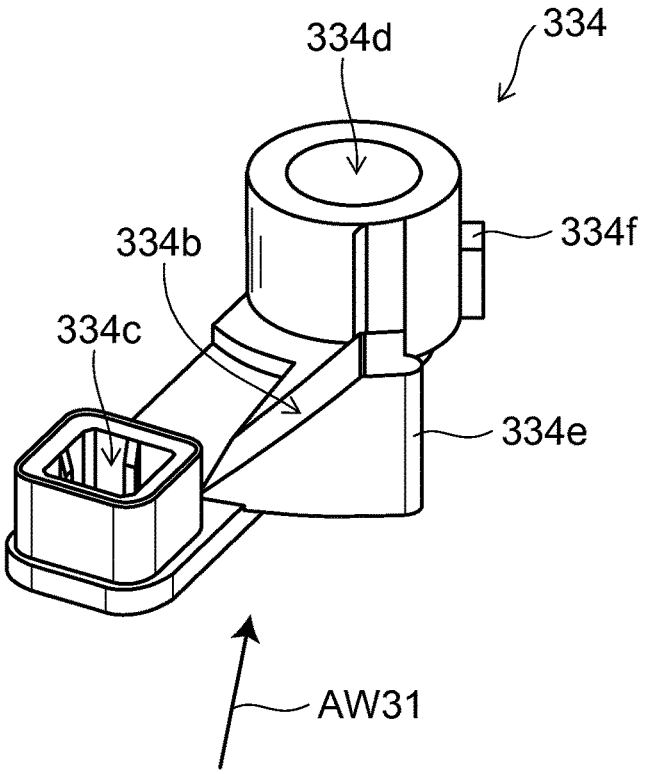
FIGS. 16A and 16B are schematic views showing the main rotary cam of this specific example.
Figure 16B:
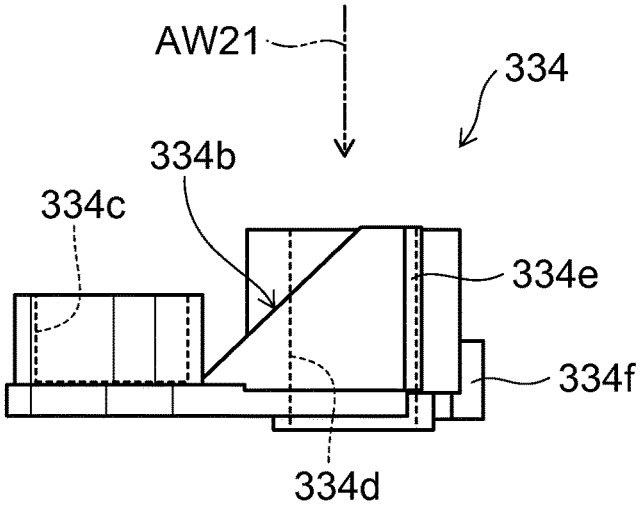

FIGS. 16A and 16B are schematic views showing the main rotary cam of this specific example.

FIG. 16A is a schematic perspective view showing the main rotary cam of this specific example. FIG. 16B is a schematic plan view showing the main rotary cam as viewed in the direction of arrow AW31 shown in FIG. 16A.

The main rotary cam 334 of this specific example includes a receiving surface 334*b*, a round part 334*e*, and a protruding part 334*f*. The receiving surface 334*b* is inclined with respect to the direction of the push operation of the operation button 310 (see arrow AW21 shown in FIGS. 12B and 16B). Thus, the operation force associated with the push operation of the operation button 210 can be converted from the direction generally perpendicular to the wall surface 10 to the direction generally parallel to the wall surface 10. The round part 334*e* pushes the inner surface 331*a* of the main link 331. The round part 334*e* has a curved shape. Thus, the round part 334*e* can stably push the inner surface 331*a* of the main link 331 irrespective of the rotation angle of the main rotary cam 334. The spring 336 is hooked on the protruding part 334*f*.

The main rotary cam 334 of this specific example includes a recess 334*c* and a hole 334*d*. The magnet 341 is held in the recess 334*c*. The shaft 334*a* provided on the base 304 is inserted into the hole 334*d*.

The structure of the sub rotary cam 335 is similar to the structure of the main rotary cam 334.

Figure 17A:
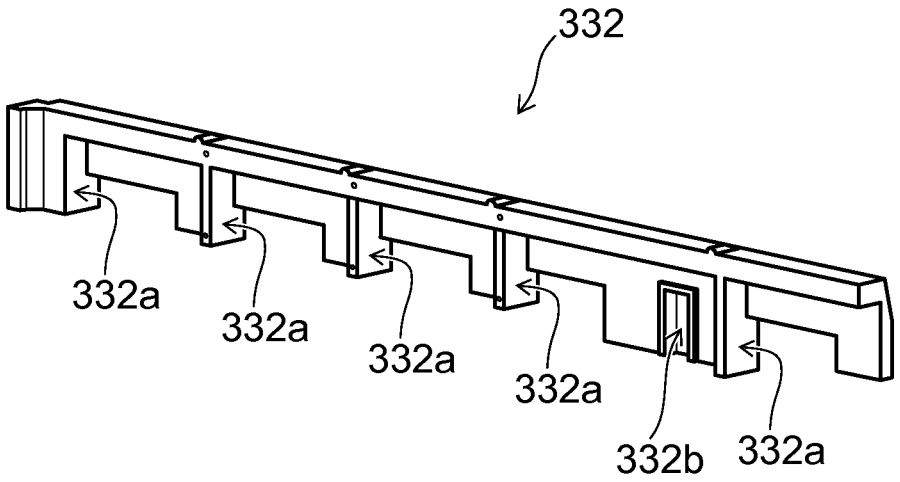
FIGS. 17A and 17B are schematic perspective views showing the sub link of this specific example.
Figure 17B:
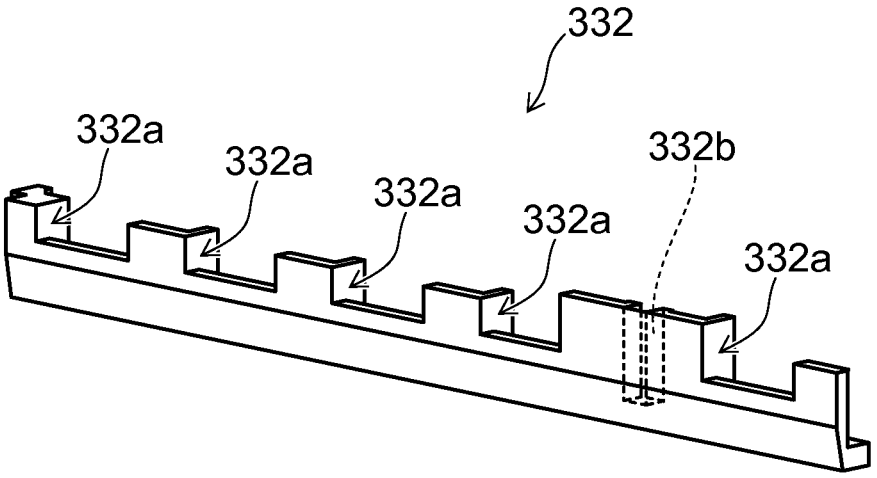

FIGS. 17A and 17B are schematic perspective views showing the sub link of this specific example.

FIG. 17A is a schematic perspective view of the sub link attached to the base as viewed from the base side. FIG. 17B is a schematic perspective view of the sub link attached to the base as viewed from the side opposite to the base (from the first casing 301 side).

The sub link 332 of this specific example has an inner surface 332*a*. The sub rotary cam 335 rotates and pushes the inner surface 332*a* of the sub link 332. Thus, the sub link 332 moves in the direction generally parallel to the wall surface 10.

The sub link 332 of this specific example includes a groove part 332*b*. The second protrusion 333*b* (see FIG. 11) of the junction arm 333 is inserted into the groove part 332*b*. That is, the second protrusion 333*b* of the junction arm 333 is inserted into the groove part 332*b* and engaged with the sub link 332. The structure of the main link 331 is similar to the structure of the sub link 332.

Figure 18A:
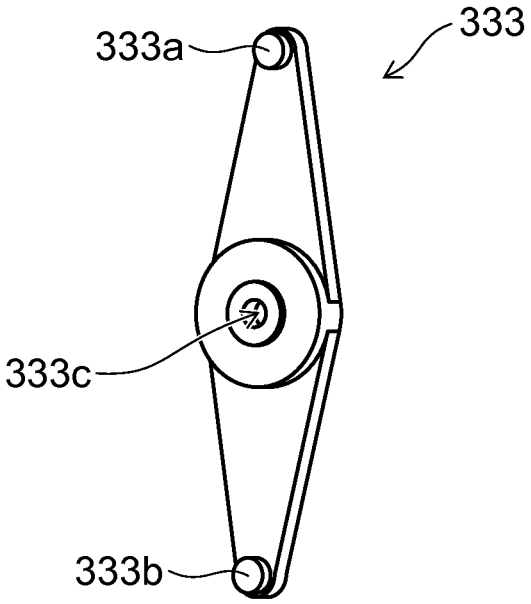
FIGS. 18A and 18B are schematic perspective views showing the junction arm of this specific example.
Figure 18B:
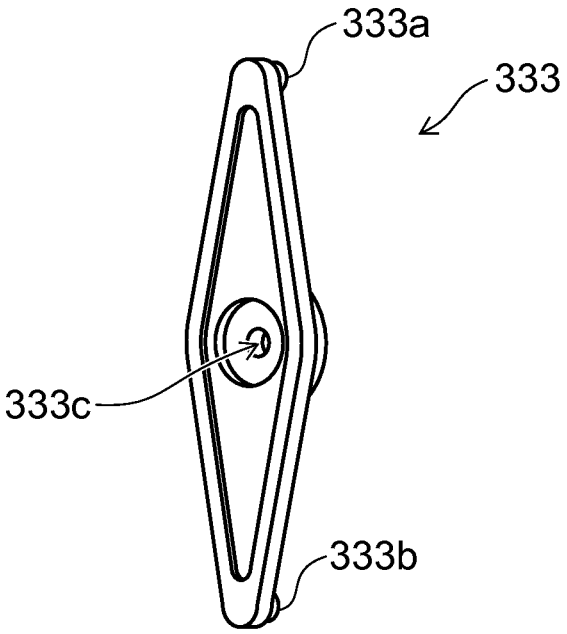

FIGS. 18A and 18B are schematic perspective views showing the junction arm of this specific example.

FIG. 18A is a schematic perspective view of the junction arm attached to the base as viewed from the side opposite to the base (from the first casing 301 side). FIG. 18B is a schematic perspective view of the junction arm attached to the base as viewed from the base side.

The junction arm 333 of this specific example includes a first protrusion 333*a* and a second protrusion 333*b*. The first protrusion 333*a* is projected toward the main link 331 in the state in which the junction arm 333 is attached to the base 304. The first protrusion 333*a* is inserted into the groove part (not shown) of the main link 331. The second protrusion 333*b* is projected toward the sub link 332 in the state in which the junction arm 333 is attached to the base 304. The second protrusion 333*b* is inserted into the groove part 332*b* of the sub link 332.

The junction arm 333 of this specific example includes a hole 333*c*. The hole 333*c* is provided between the first protrusion 333*a* and the second protrusion 333*b*. The shaft 333*d* (see FIG. 11) provided on the base 304 is inserted into the hole 333*c*. Thus, the junction arm 333 can rotate about the shaft 333*d*.

Next, the detection section of this specific example is described with reference to the drawings.

Figure 19A:
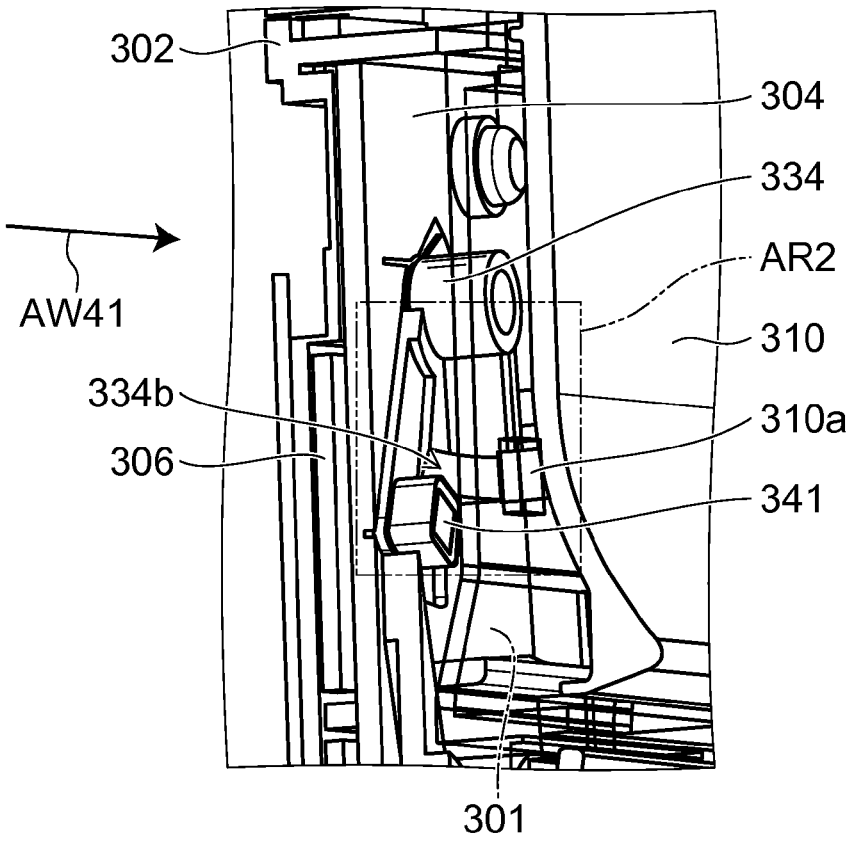
FIGS. 19A and 19B are schematic views for describing the detection section of this specific example.
Figure 19B:
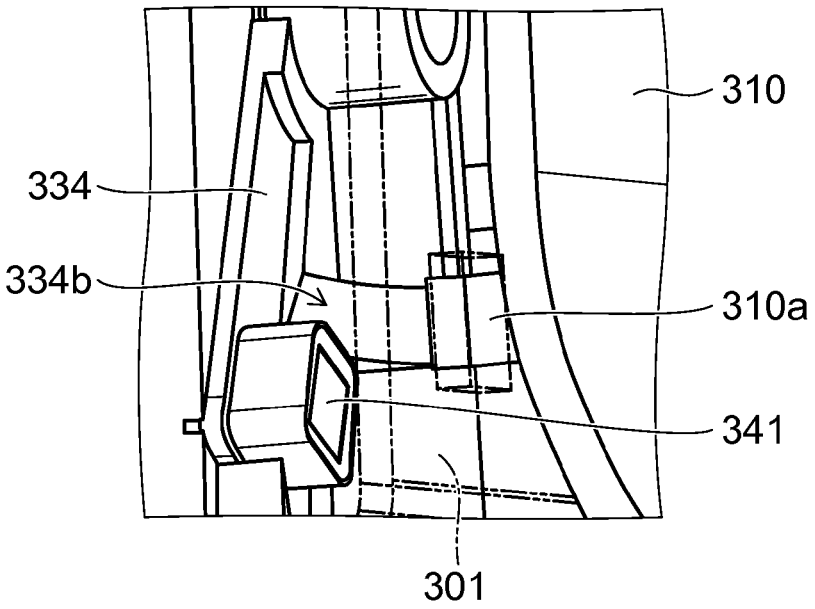

FIGS. 19A and 19B are schematic views for describing the detection section of this specific example.

Figure 20:
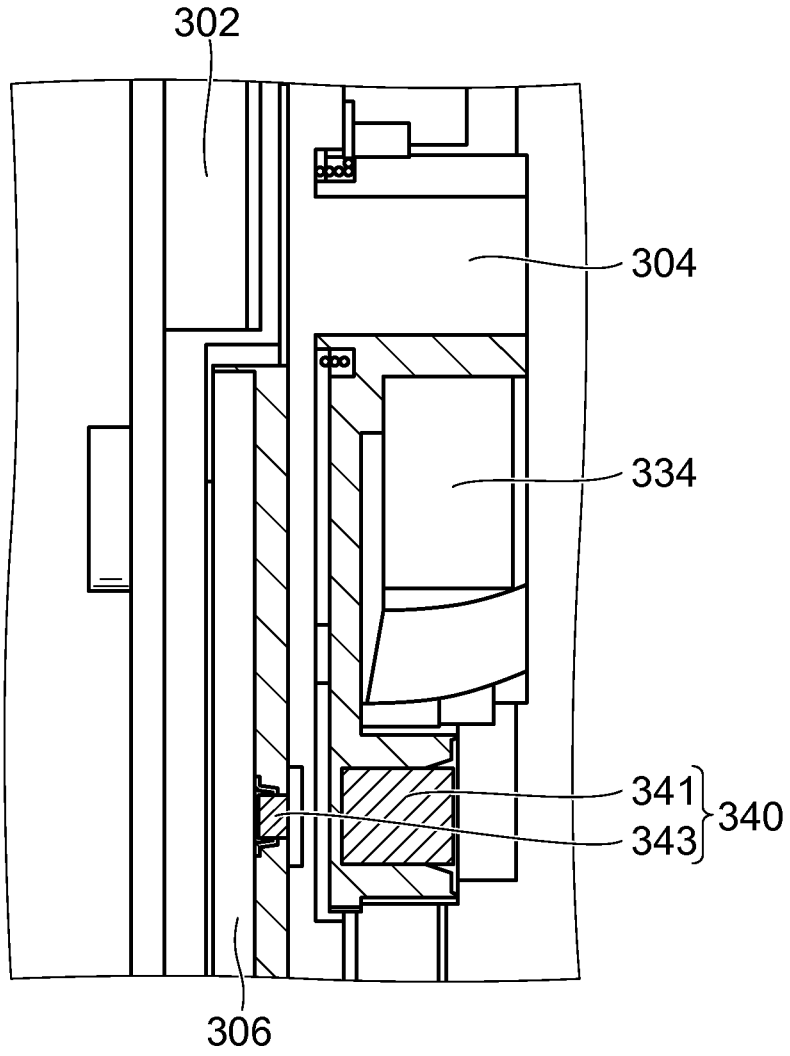
FIG. 20 is a schematic plan view as viewed in the direction of arrow AW41 shown in FIG. 19A.

FIG. 20 is a schematic plan view as viewed in the direction of arrow AW41 shown in FIG. 19A.

Figure 21:
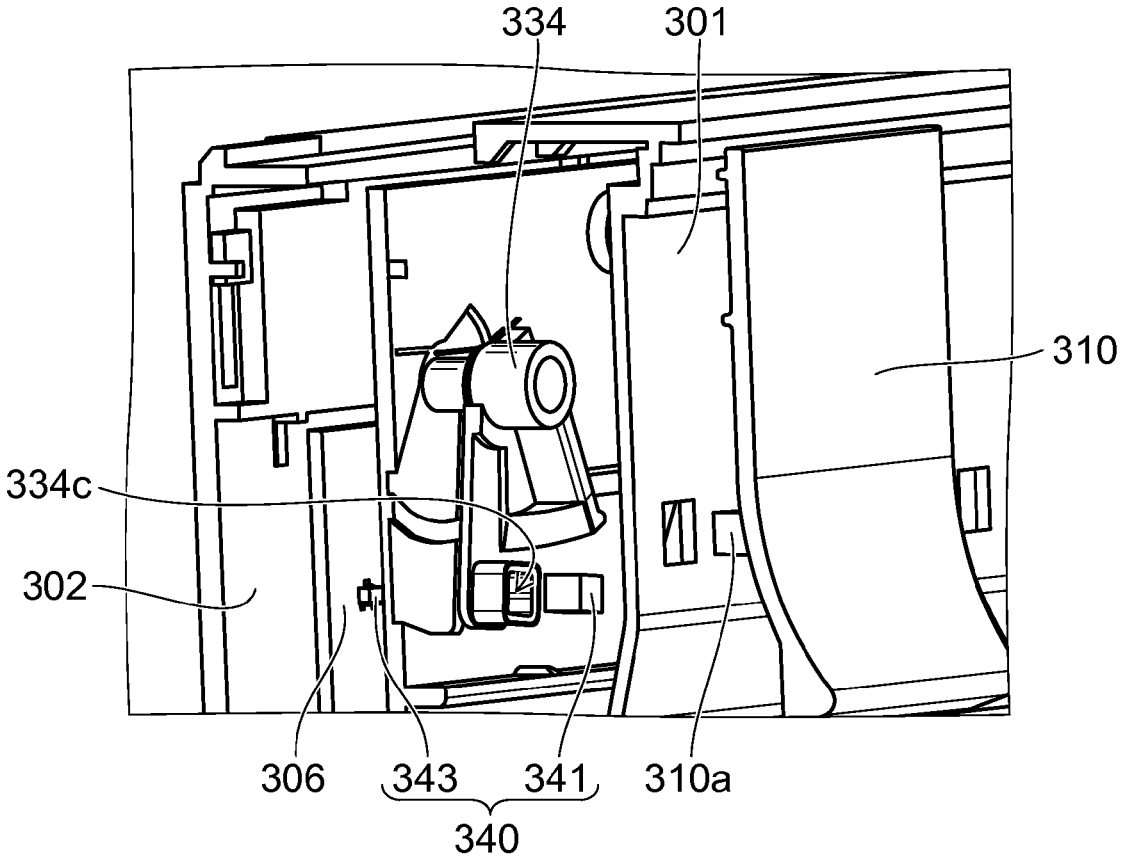
FIG. 21 is a schematic exploded view for describing the detection section of this specific example.

FIG. 21 is a schematic exploded view for describing the detection section of this specific example.

FIG. 19A is a schematic perspective view for describing the detection section of this specific example. FIG. 19B is a schematic enlarged view enlarging region AR2 shown in FIG. 19A.

As shown in FIGS. 20 and 21, the detection section 340 of this specific example includes a magnet 341 and a Hall element 343. The detection section 340 of this specific example corresponds to the detection section 241 described above with reference to FIG. 4. As described above with reference to FIG. 14, the magnet 341 is held in the recess 334*c* of the main rotary cam 334. As shown in FIGS. 20 and 21, the Hall element 343 is provided on the substrate 306.

As described above with reference to FIGS. 12A and 12B, when e.g. a user pushes the operation button 310, the pushing part 310*a* of the operation button 310 pushes the receiving surface 334*b* of the main rotary cam 334. Thus, the main rotary cam 334 rotates about the shaft 334*a*.

The magnet 341 is held on the main rotary cam 334. Thus, when the main rotary cam 334 rotates, the magnet 341 moves with the main rotary cam 334. This changes the distance between the magnet 341 and the Hall element 343. Thus, the push operation of the operation button 310 is detected. The placement position of the magnet 341 and the Hall element 343 is not limited to this specific example. For instance, the Hall element 343 may be provided on the main rotary cam 334, and the magnet 341 may be provided on the substrate 306. The method for detecting the push operation of the operation button 310 is not limited to this specific example.

The detection section 340 including the magnet 341 provided on the main rotary cam 334 has been described with reference to FIGS. 19A to 21. A magnet 341 is held also in the recess (not shown) of the sub rotary cam 335. Thus, the push operation of the operation button 310 is detected also by the change of the distance between the magnet 341 moving with the rotation of the sub rotary cam 335 and the Hall element 343.

The embodiments of the invention have been described above. However, the invention is not limited to the above description. Those skilled in the art can appropriately modify the design of the above embodiments. Such modifications are also encompassed within the scope of the invention as long as they include the features of the invention. For instance, the shape, dimension, material, and placement of each element of the remote control device 200, 300 and the transfer mechanism 230, 330, and the installation mode of the operation button 210, 310 and the detection section 340 are not limited to those illustrated above, but can be appropriately modified.

Furthermore, the elements of the above embodiments can be combined with each other as long as technically feasible.

Such combinations are also encompassed within the scope of the invention as long as they include the features of the invention.

What is claimed is:

1. A remote control device for a toilet device, comprising:

an operation button being capable of a push operation and being configured to operate an equipment in response to the push operation; and a power generator configured to generate a power by being pressed in response to the push operation, a direction of the pressing being parallel to a wall surface on which the remote control device is placed.

2. The device according to claim 1, further comprising:

a remote control body including a member attached to the wall surface; and a base provided inside the remote control body, the power generator being held on the base.

3. The device according to claim 1, further comprising:

a transfer mechanism including a member performing the pressing by moving in the direction parallel to the wall surface in response to the push operation.

4. The device according to claim 3, wherein the operation button includes a pushing part, and the transfer mechanism includes a receiving part configured to receive a force from the pushing part in response to the push operation and to move the member performing the pressing.

5. The device according to claim 1, wherein the direction of the push operation has a component perpendicular to the wall surface.

* * * * *